US005262799A

United States Patent [19]

Ono et al.

[11] Patent Number: 5,262,799

[45] Date of Patent: Nov. 16, 1993

[54] RECORDING APPARATUS WITH AUXILIARY RECORDING AND METHOD FOR SAME

[75] Inventors: Takeshi Ono, Yokohama; Satoshi Wada, Kawasaki; Makoto Kobayashi, Tama; Takehiro Yoshida, Tokyo; Tomoyuki Takeda, Yokohama; Yasushi Ishida, Tokyo; Minoru Yokoyama, Yokohama; Akihiro Tomoda, Yokohama; Masakatsu Yamada, Yokohama; Takashi Awai, Yokohama, all of Japan

[73] Assignee: Canon Kabushiki Kaisha, Tokyo, Japan

[21] Appl. No.: 4,669

[22] Filed: Jan. 14, 1993

Related U.S. Application Data

[63] Continuation of Ser. No. 553,755, Jul. 18, 1990, abandoned.

[30] Foreign Application Priority Data

| | | | |
|---|---|---|---|
| Jul. 19, 1989 | [JP] | Japan | 1-184412 |
| Jul. 31, 1989 | [JP] | Japan | 1-198268 |
| Jul. 31, 1989 | [JP] | Japan | 1-198269 |
| Jul. 13, 1990 | [JP] | Japan | 2-184345 |

[51] Int. Cl.[5] ..... B41J 2/38

[52] U.S. Cl. ..... 346/76 PH

[58] Field of Search ..... 346/76 PH; 400/120

[56] References Cited

U.S. PATENT DOCUMENTS

| | | | |
|---|---|---|---|
| 4,456,392 | 6/1984 | Nozaki et al. | 340/120 |
| 4,463,359 | 7/1984 | Ayata et al. | 346/1.1 |
| 4,520,373 | 5/1985 | Ayata et al. | 346/140 R |
| 4,724,447 | 2/1988 | Oda | 346/76 PH |
| 4,875,056 | 10/1989 | Ono | 346/76 PH |
| 4,963,884 | 10/1990 | Kiguchi et al. | 346/1.1 |

FOREIGN PATENT DOCUMENTS

| | | | |
|---|---|---|---|
| 0295953 | 12/1988 | European Pat. Off. . | |
| 0360279 | 3/1990 | European Pat. Off. . | |
| 0408073 | 1/1991 | European Pat. Off. . | |
| 58-201686 | 11/1983 | Japan . | |
| 0038078 | 3/1984 | Japan | 346/76 PH |
| 0255463 | 12/1985 | Japan | 346/76 PH |
| 0078671 | 4/1986 | Japan | 346/76 PH |
| 62-3969 | 1/1987 | Japan . | |
| 0003969 | 1/1987 | Japan | 346/76 PH |
| 0094360 | 4/1987 | Japan | 346/76 PH |
| 0164568 | 7/1987 | Japan | 346/76 PH |
| 62-234957 | 10/1987 | Japan . | |

*Primary Examiner*—Benjamin R. Fuller
*Assistant Examiner*—N. Le
*Attorney, Agent, or Firm*—Fitzpatrick, Cella, Harper & Scinto

[57] ABSTRACT

A thermal transfer recording apparatus for transferring an ink of an ink sheet onto a recording medium to record an image on the recording medium, includes an ink sheet convey unit for conveying the ink sheet, a recording medium convey unit for conveying the recording medium, a recording unit which is driven in correspondence with image data and records an image on the recording medium using the ink sheet, and a control unit for, when a next recording operation is not instructed after image recording by the recording unit, driving the recording unit with an energy lower than that in a normal image recording mode, and for, when a time interval until the next recording operation becomes equal to or longer than a predetermined period of time after the above driving operation, driving the recording unit with an energy lower than that in the normal image recording mode at a predetermined time interval.

12 Claims, 19 Drawing Sheets

| |
|---|
| FIG. 5A |
| FIG. 5B |

| |
|---|
| FIG. 9A |
| FIG. 9B |

RECORDING APPARATUS WITH AUXILIARY RECORDING AND METHOD FOR SAME

This application is a continuation of application Ser. No. 07/553,755 filed Jul. 18, 1990, now abandoned.

BACKGROUND OF THE INVENTION

1. Field of the Invention

The present invention relates to a recording apparatus for recording an image on a recording medium and a recording method.

The recording apparatus includes, e.g., those in the form of a facsimile apparatus, an electronic typewriter, a copying machine, a printer apparatus, and the like.

2. Related Background Art

In general, a thermal transfer printer employs an ink sheet in which a hot melt (or thermal sublimation) ink is coated on a base film. The ink sheet is selectively heated by a thermal head in accordance with an image signal, and a melted (or sublimated) ink is transferred onto a recording sheet, thereby performing image recording. In a thermal transfer recording system, a time interval between recording operations for two adjacent lines is often prolonged. In this case, in order to prevent the thermal head from being completely cooled, so-called auxiliary recording is proposed. That is, the thermal head is heated so as not to perform transfer recording while recording data of the thermal head remains the same. The auxiliary recording will be described below with reference to FIG. 7.

FIG. 7 shows image recording timings for a line type thermal head. Timings T101 to T104 correspond to output timings of a print command for instructing start of printing and trigger timings of a recording sheet convey motor. In FIG. 7, timings 70 to 73 indicate actual recording timings for one line. During this interval, a recording sheet is conveyed by one line, and one-line recording is performed. As indicated by the timings 71 and 72, when recording for the next line is instructed during recording for the present line, recording processing for the next line is started immediately after recording for the present line is completed. However, when a recording interval must be set until recording for the next line, auxiliary recording operations are executed, as indicated by timings 74 to 76.

In the above-mentioned prior art, however, when the recording interval is prolonged, the auxiliary recording is spoiled, and heat of the thermal head is dissipated. As a result, a recording density for the next line may be decreased. In particular, when lines are intermittently recorded in, e.g., a facsimile apparatus, a rising time of a heating operation of the thermal head is delayed, and white stripes due to an insufficient image density may appear in a recorded image.

On the other hand, a thermal transfer printer employs an ink sheet in which a hot melt (or thermal sublimation) ink is coated on a base film. The ink sheet is selectively heated by a thermal head in accordance with an image signal, and a melted (or sublimated) ink is transferred onto a recording sheet, thereby performing image recording. Since an ink of the ink sheet is normally completely transferred to a recording sheet by a single image recording operation (i.e., a so-called one-time sheet), the ink sheet is conveyed by a length corresponding to a recording length after recording of one character or one line is completed, and the unused portion of the ink sheet must be reliably conveyed to the next recording position. For this reason, an amount of use of the ink sheet is increased, and running cost of the thermal transfer printer tends to be higher than that of a conventional thermal printer for recording an image on a heat sensitive sheet.

In order to solve this problem, as disclosed in U.S. Pat. No. 4,456,392, Japanese Laid-Open Patent Application No. 58-201686, and Japanese Patent Publication No. 62-58917, a thermal transfer printer which conveys a recording sheet and an ink sheet to have a speed difference therebetween is proposed.

The present invention has been made in view of the inventions described in these prior arts. As described in these prior arts, an ink sheet which can perform an image recording operation a plurality of (n) times (so-called multi-print sheet) is known. When an image is recorded over a recording length L using this ink sheet, a convey length of the ink sheet conveyed upon completion of or during image recording can be smaller than the length L ($L/n : n > 1$). Thus, a use efficiency of the ink sheet can be n times that of a conventional apparatus, and a decrease in running cost of a thermal transfer printer can be expected. This recording method will be referred to as a multi-print method hereinafter.

In multi-print recording using such an ink sheet, an ink in an ink layer of the ink sheet is separately heated n times. In each heating, a shearing force is generated between a melted (or sublimated) ink and a non-melted (or non-sublimated) ink, thereby transferring ink onto the recording sheet. For this reason, when a time until recording for the next line is prolonged after recording for a certain line and an ink temperature is decreased, the shearing force between the melted and non-melted ink portions is increased, and the ink sheet and the recording sheet are not easily separated from each other. This phenomenon typically occurs when one-line recording data includes much black information, and poses a serious problem when a time interval between the present line and the next line is not constant and is relatively long.

The present applicant proposed a thermal transfer recording apparatus and a facsimile apparatus using the same (Japanese Patent Application No. 63-281375 filed on Nov. 9, 1988). In this apparatus, when identical data is recorded while a recording medium stands still, and a recording operation is interrupted for a predetermined period of time or more, a recording means is heated until the next recording operation to improve quality of a recorded image, and to facilitate separation between of the ink sheet and recording medium.

The present invention is made by further developing the above invention.

SUMMARY OF THE INVENTION

It is an object of the present invention to provide a thermal transfer recording apparatus and a method, which can improve image quality.

It is another object of the present invention to provide a thermal transfer recording apparatus and a method which can eliminate sticking between an ink sheet and a recording medium.

It is still another object of the present invention to provide a thermal transfer recording apparatus and a method, which when the start of the next recording is not instructed upon completion of recording for a certain line (e.g., when line recording operations are speed-controlled in correspondence with a transmission or decoding time of image data and are intermittently performed like in facsimile recording), a recording means such as a thermal head is heated using the same image data at predetermined time intervals until the next recording is started, thus suppressing a decrease in temperature of a heating element of, e.g., the thermal head and eliminating recording density nonuniformity on the recording medium.

It is still another object of the present invention to provide a thermal transfer recording apparatus and a method, which gradually prolongs an interval between after heat operations after recording as a time elapses, thereby eliminating heat accumulation. For example, the apparatus and method of the present invention can satisfy the following relation:

$$\Delta T_n < \Delta T_{n+1} \ (n=1, 2, 3, \ldots)$$

where $\Delta T_n$ is the time interval between an nth after heat operation and an (n+1)th after heat operation.

It is still another object of the present invention to provide a thermal transfer recording apparatus and a facsimile apparatus, which can clearly record even an isolated point.

DETAILED DESCRIPTION OF THE PREFERRED EMBODIMENTS

A preferred embodiment of the present invention will be described below with reference to the accompanying drawings.

Facsimile Apparatus (FIGS. 1 to 4)

Figure 1:
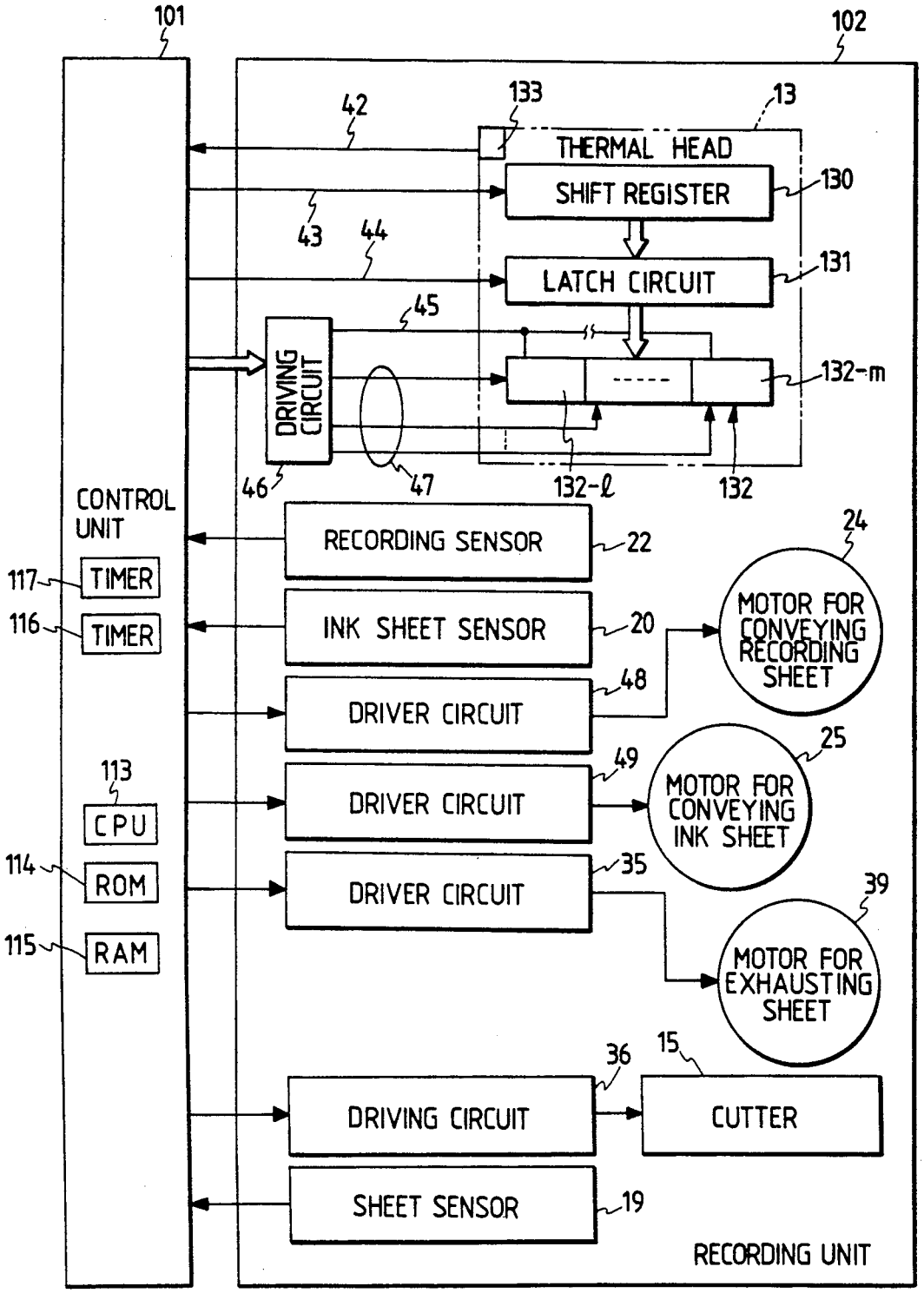
FIG. 1 is a block diagram showing electrical connections between a control unit and a recording unit according to an embodiment of the present invention.
Figure 2:
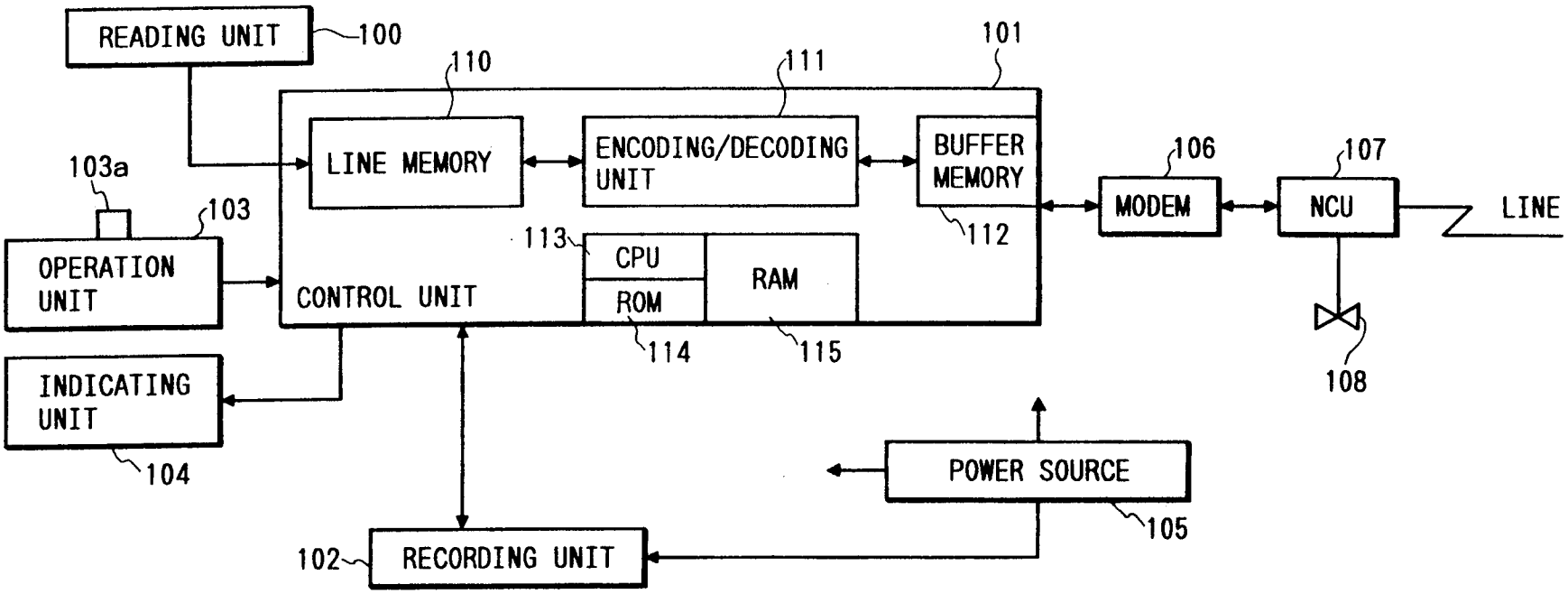
FIG. 2 is a schematic block diagram showing an arrangement of a facsimile apparatus of the embodiment shown in FIG. 1.
Figure 3A:
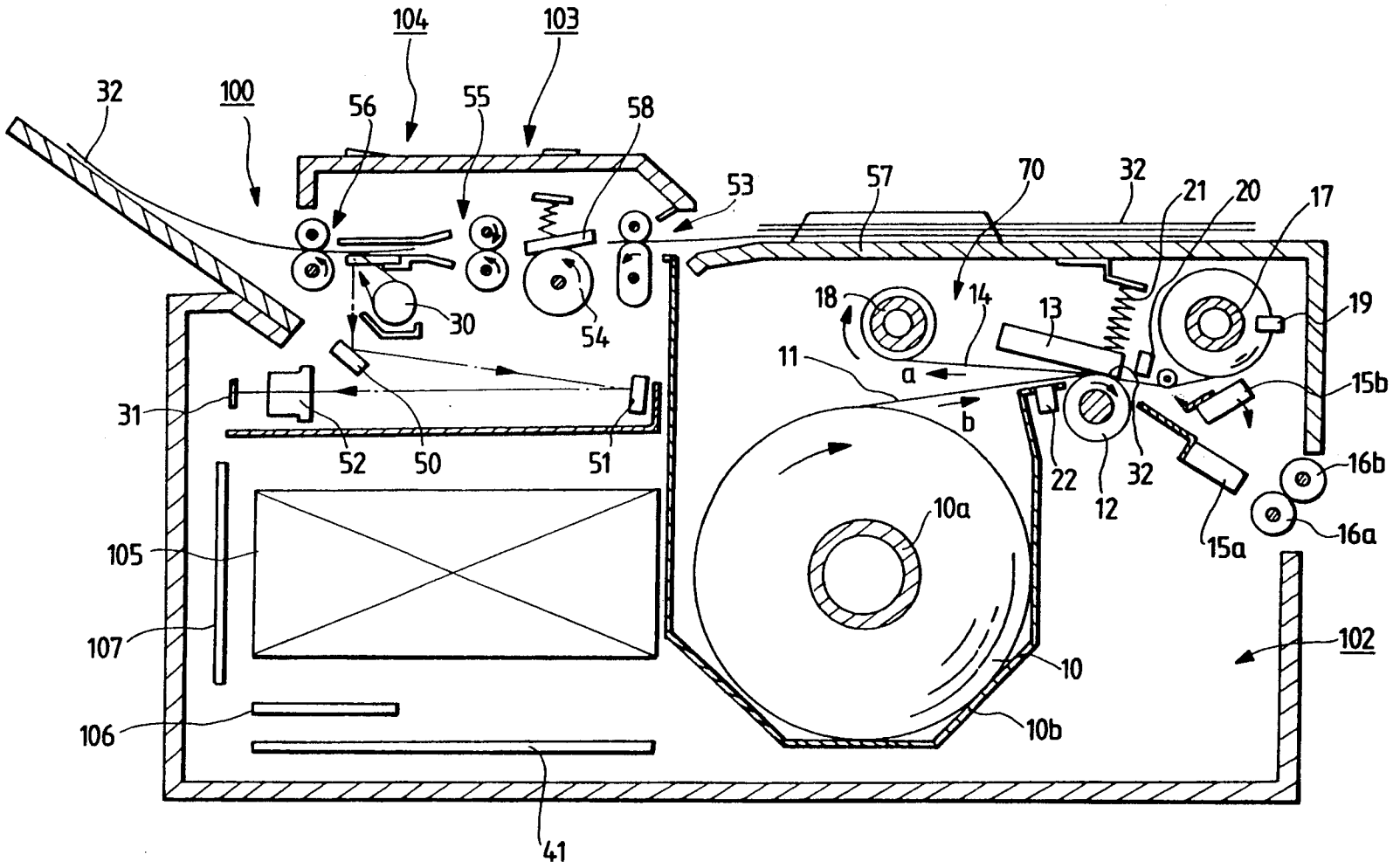
FIG. 3A is a side sectional view showing a mechanism portion of the facsimile apparatus of the embodiment shown in FIG. 1.
Figure 3B:
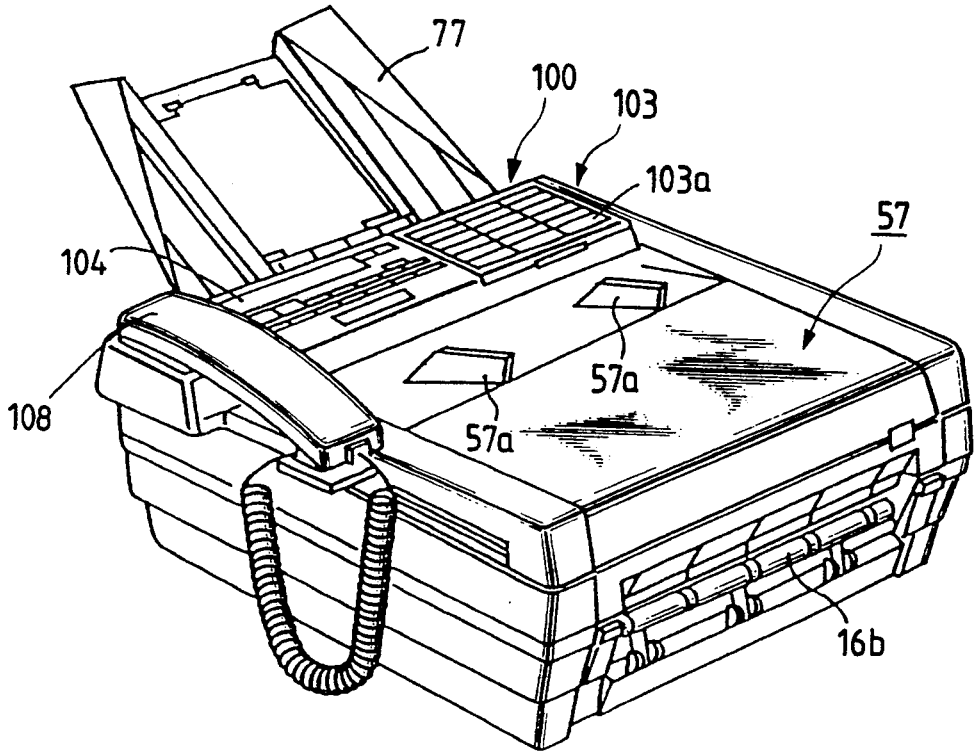
FIG. 3B is a perspective view showing an outer appearance of the facsimile apparatus.
Figure 4:
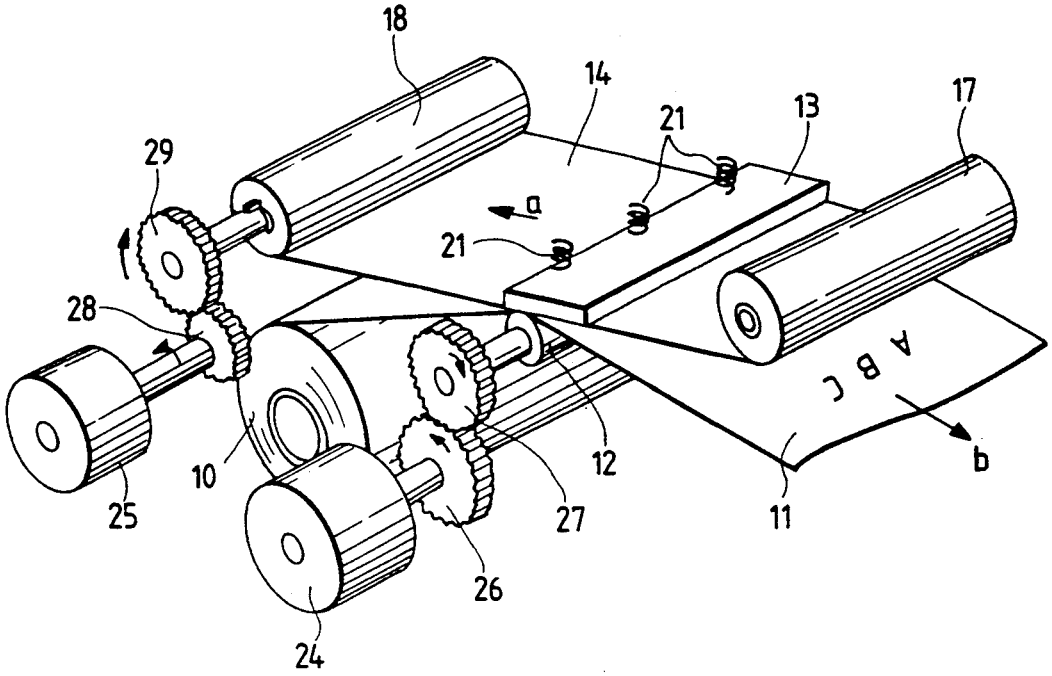
FIG. 4 is a perspective view showing a structure of a convey system of an ink sheet and a recording medium.

FIGS. 1 to 4 show a thermal transfer printer using an embodiment of the present invention. In this case, the present invention is applied to a facsimile apparatus. FIG. 1 is a block diagram showing electrical connections between a control unit 101 and a recording unit 102 of the facsimile apparatus, FIG. 2 is a schematic block diagram showing an arrangement of the facsimile apparatus, FIG. 3A is a side sectional view of the facsimile apparatus, FIG. 3B is a perspective view showing an outer appearance of the facsimile apparatus, and FIG. 4 is a view showing a convey mechanism of a recording sheet and an ink sheet.

The schematic arrangement of the facsimile apparatus will be described below with reference to FIG. 2.

In FIG. 2, a reading unit 100 photoelectrically reads an original and outputs a digital image signal to a control unit 101 of its own apparatus (in a copy mode) or of another apparatus (in a facsimile mode). The reading unit 100 comprises an original conveying motor, an image sensor such as a CCD, and the like. The arrangement of the control unit 101 will be described below. A line memory 110 stores image data for one line. When original image data is transmitted (in a facsimile mode) or is copied (in a copy mode), the line memory 110 stores image data for one line from the reading unit 100, and when image data is received, it stores received image data for one line which is decoded. The stored data is output to a recording unit 102, thus performing image formation. An encoding/decoding unit 111 encodes image data to be transmitted based on, e.g., MH coding, and decodes received encoded image data to convert it into image data. A buffer memory 112 stores encoded image data to be transmitted or received encoded image data. These units of the control unit 101 are controlled by a CPU 113 comprising, e.g., a microprocessor. The control unit 101 comprises a ROM 114 for storing a control program of the CPU 113, and various data, a RAM 115 for temporarily storing various data as a work area of the CPU 113, and the like in addition to the CPU 113.

The recording unit 102 comprises a thermal line head, and performs image recording on a recording sheet by a thermal transfer recording method. The arrangement of the recording unit will be described in detail later with reference to FIG. 3A. An operation unit 103 includes various function instruction keys such as a transmission start key, telephone number input keys, and the like. A switch 103*a* is used to instruct a type of ink sheet 14 to be used. When the switch 103*a* is ON, it indicates that a multi-print ink sheet is loaded; otherwise, it indicates that a normal ink sheet (one-time ink sheet) is loaded. An indicating unit 104 is normally arranged adjacent to the operation unit 103, and indicates various functions and states of an apparatus. A power source unit 105 supplies electric power to the entire apparatus. A modem 106 modulates/demodulates a transmission/-reception signal. A network control unit (NCU) 107 performs communication control with a line. A telephone set 108 comprises, e.g., a telephone dial.

The arrangement of the recording unit 102 will be described below with reference to FIGS. 3A and 3B. The same reference numerals in FIGS. 3A and 3B denote the same parts as in FIG. 2.

In FIG. 2, a sheet roll 10 is obtained by winding a recording sheet 11 as normal paper in a roll shape. The sheet roll 10 is rotatably stored in the apparatus so that it can feed the recording sheet 11 to a thermal head unit 13 upon rotation of a platen roller 12 in a direction of the arrow. A sheet roll loading unit 10*b* detachably loads the sheet roll 10. The platen roller 12 conveys the recording sheet 11 in a direction of an arrow b, and presses an ink sheet 14 and the recording sheet 11 between itself and a heat generating resistor or member 132 of the thermal head 13. The recording sheet 11 on which an image is recorded upon heating of the thermal head 13 is conveyed toward discharge rollers 16 (16*a* and 16*b*) upon further rotation of the platen roller 12, and is cut into pages upon meshing of rotary cutters 15 (15*a* and 15*b*) after image recording for one page is completed. Then, the recording sheet is discharged.

The ink sheet 14 is wound around an ink sheet feed roller 17. The ink sheet fed from the roller 17 is taken up by an ink sheet take-up roller 18 in a direction of arrow a. The roller 18 is driven by an ink sheet convey motor (to be described later). The ink sheet feed roller 17 and the ink sheet take-up roller 18 are detachably loaded in an ink sheet loading unit 70 in the apparatus main body. A sensor 19 detects a remaining amount and a convey speed of the ink sheet 14. An ink sheet sensor 20 detects the presence/absence of the ink sheet 14. Springs 21 are arranged to press the thermal head 13 against the platen roller 12 through the recording sheet 11 and the ink sheet 14. A recording sensor 22 detects the presence/absence of the recording sheet.

The arrangement of the reading unit 100 will be described below.

In FIG. 3A, a light source 30 illuminates an original 32. Light reflected by the original 32 is incident on a CCD sensor 31 via an optical system (mirrors 50 and 51, and a lens 52), and is then converted into an electrical signal. The original 32 is conveyed by convey rollers 53, 54, 55, and 56 driven by an original convey motor (not shown) in correspondence with its reading speed. A plurality of originals 32 placed on an original table 57 are separated one by one upon cooperation of the convey roller 54 and a pressing separation segment 58 while being guided along a slider 57*a*. The separated original is fed to the reading unit 100, and is then discharge onto a tray 77 after reading.

A control board 41 constitutes the principal part of the control unit 101. The control board 41 outputs various control signals to respective portions of the apparatus. The facsimile apparatus also includes the power source unit 105, the modem board unit 106, and the NCU board unit 107.

FIG. 4 shows in detail a convey mechanism of the ink sheet 14 and the recording sheet 11.

In FIG. 4, a motor 24 drives the platen roller 12 to convey the recording sheet 11 in a direction of arrow b opposite to the direction of arrow a. A motor 25 is used to convey the ink sheet 14 in the direction of arrow a. Transmission gears 26 and 27 transmit rotation of the motor 24 to the platen roller 12. Transmission gears 28 and 29 transmit rotation of the motor 25 to the take-up roller 18.

Since the recording sheet 11 and the ink sheet 14 are conveyed in opposite directions, the direction in which an image is sequentially recorded along the length of the recording sheet 11 (the direction of the arrow a, i.e., a direction opposite to the convey direction of the recording sheet 11) coincides with the convey direction of the ink sheet 14. When the ink sheet 14 comprises a multi-ink sheet which can perform recording several times at the same position, if the convey speed of the recording sheet 11 is represented by $V_P$ and the convey speed of the ink sheet 14 is represented by $V_I$, $V_P = -nV_I$ is established. In this case, "−" implies that the convey directions of the recording sheet 11 and the ink sheet 14 are opposite to each other.

FIG. 1 shows electrical connections between the control unit 101 and the recording unit 102 in the facsimile apparatus of this embodiment, and the same reference numerals in FIG. 1 denote the same parts as in other figures.

The thermal head 13 is a line head (having heat generating element over its recording width). The thermal head 13 comprises a shift register 130 for receiving serial recording data for one line from the recording unit 101 and a shift clock 43, a latch 131 for latching data of the shift register 130 in response to a latch signal 44, and a heat generating element 132 comprising heat generating resistors for one line. The heat generating resistors 132 are driven while being divided into m blocks, as indicated by 132-1 to 132-m. A temperature sensor 133 is attached to the thermal head 13 to detect a temperature of the thermal head 13. An output signal 42 from the temperature sensor 133 is A/D-converted by the control unit 101, and the digital signal 42 is input to the CPU 113. Thus, the CPU 113 can detect the temperature of the thermal head 13, and changes a pulse width of a strobe signal 47 or a driving voltage of the thermal head 13, thereby changing an energy applied to the thermal head 13 according to characteristics of the ink sheet 14. The CPU 113 sets measurement times in programmable timers 116 and 117, and instructs them to start time measurement. The programmable timers 116 and 117 output interrupt signals, time-out signals, or the like to the CPU 113 every instructed time.

The type (characteristic) of ink sheet 14 is instructed upon a manual operation of the switch 103*a* of the operation unit 103 described above by an operator. Note that a mark printed on the ink sheet 14 may be automatically detected to discriminate its type. Alternatively, a mark, a notch, a projection, or the like provided to a cartridge of an ink sheet may be automatically detected to discriminate the type of an ink sheet.

A driving circuit 46 receives a driving signal of the thermal head 13, and outputs the strobe signal 47 for driving the thermal head 13 in units of blocks. Note that the driving circuit 46 can change a voltage to be output to a power source line 45 for supplying a current to the heat generating element 132 of the thermal head 13 to change an energy to be applied to the thermal head 13. A driving circuit 36 drives the cutters 15 to mesh with each other, and includes a motor for driving the cutters. A motor 39 rotates the discharge rollers 16 to discharge a sheet. Driver circuits 35, 31, and 32 respectively rotate the motors 39, 24, and 25. Note that these motors 39, 24, and 25 comprise stepping motors in this embodiment.

However, the present invention is not limited to this. For example, these motors may comprise, e.g., DC motors.

Recording Operation (FIGS. 1 to 6)

Figures 5, 5A:
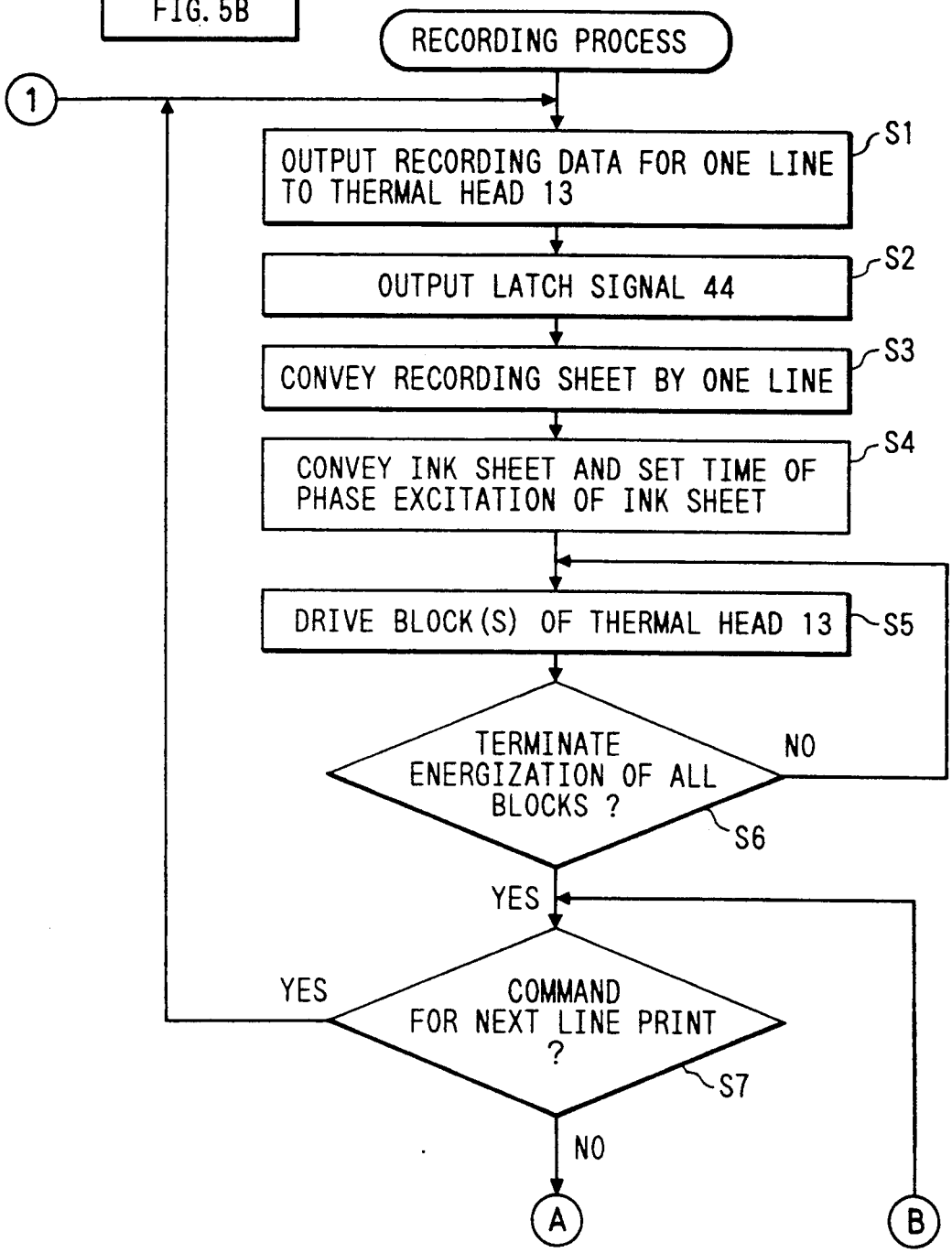
FIGS. 5A and 5B are a flow chart showing recording processing in the facsimile apparatus of this embodiment.
Figure 5B:
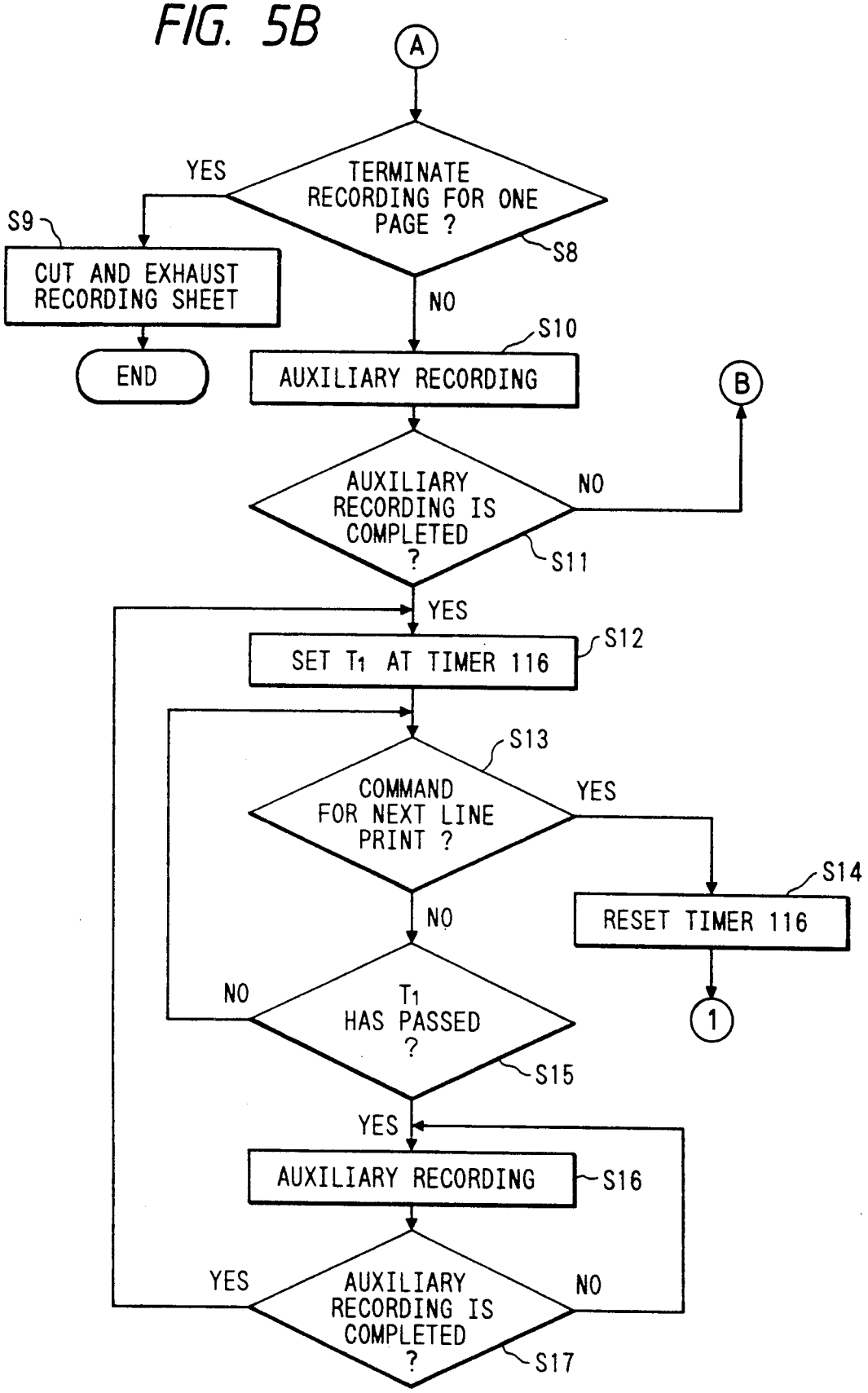

FIG. 5 is a flow chart showing recording processing for one page in the facsimile apparatus of the first embodiment. A program for executing this processing is stored in the ROM 114 of the control unit 101.

This processing is started when image data for one line is stored in the line memory 110 and the apparatus is ready to start a recording operation. In step S1, recording data for one line are serially output to the shift register 130. Upon completion of transportation of the recording data for one line, the latch signal 44 is output in step S2 to store the recording data for one line in the latch circuit 131.

In step S3, the recording sheet 11 is conveyed by one line. This one-line length corresponds to a length of one dot recorded by the thermal head 13. The flow advances to step S4, and the motor 25 is driven to convey the ink sheet 14 by 1/n (e.g., n=4) lines. The number of steps required for conveying the recording sheet 11 by one line is one. When the ink sheet 14 is conveyed by one line, the motor 25 is driven by four steps (when n=4). This operation can be realized by setting the ratio of minimum step angles of the motors 24 and 25 to be 4 : 1 or setting a gear ratio of the transmission gears 28 and 29 to be 4 : 1.

In step S5, one of the blocks of the heat generating resistors 132 is energized to record an image, and it is checked in step S6 if energization of all the blocks is completed. If it is determined in step S6 that energization of all the blocks is not completed and recording for one line is not completed, the flow returns to step S5, and the next block is energized. If recording for one line is completed, the flow advances from step S6 to step S7 to check if a print command for the next line is input. If YES in step S7, the flow returns to step S1, and image recording processing for the next line is started without performing auxiliary recording. Note that an energization time of each block of the thermal head is about 0.6 ms, and the time required for recording for one line is about 2.5 ms.

If NO in step S7, i.e., if the print command for the next line is not input (e.g., when recording processing for one page is completed, and when recording operations for lines are intermittently executed while being speed-adjusted according to a transmission speed or a decoding time of image data), the flow advances to step S8 to check if recording processing for one page is completed. If YES in step S8, the flow advances to step S9, and the recording sheet 11 is cut into a page by the cutter 15. The cut recording sheet on which an image has already been recorded, is conveyed toward the discharge rollers 16, and is discharged from the apparatus.

If NO in step S8, the flow advances to step S10, and the heat generating elements 132 of the thermal head 13 are energized without conveying the recording sheet 11 and the ink sheet 14, thus performing an auxiliary heat operation. In the auxiliary heat mode, the heat generating elements 132 of the thermal head 13 are heated with a pulse width which is shorter than that in a normal image recording mode and which does not cause transfer recording (in this embodiment, an energization time is set to be about 0.2 ms per block).

Upon completion of the auxiliary heat operation in step S11, the flow advances to step S12, and a time T1 (e.g., 5 ms) is set in the timer 116. The flow then advances to step S13 to check if the print start command for the next line is input like in step S7. If YES in step S13, the flow advances to step S14, the timer 116 is reset, and the flow returns to step S1. However, if no print command for the next line is input in step S13, the flow advances to step S15 to check based on a signal from the timer 116 if the time T1 has passed (in this embodiment, T1 is set to be about 5 ms). If NO in step S15, the flow returns to step S13; otherwise, the flow advances to step S16, and the auxiliary heat operation is executed again to heat the thermal head 13. The auxiliary heat time may or may not be the same as that in step S10. Upon completion of the auxiliary heat operation in step S17, the flow returns to step S12, and the time T1 is set in the timer 116 again to repeat the above-mentioned processing.

In this embodiment, when a recording interval is prolonged, the thermal head 13 is energized in a predetermined cycle (e.g., 5 ms) to generate heat, thereby preventing a decrease in heat accumulation amount, or temperature, of the thermal head 13.

Note that data used in the auxiliary heat mode may be recording data of the immediately preceding line or may be all black data.

Figure 6:
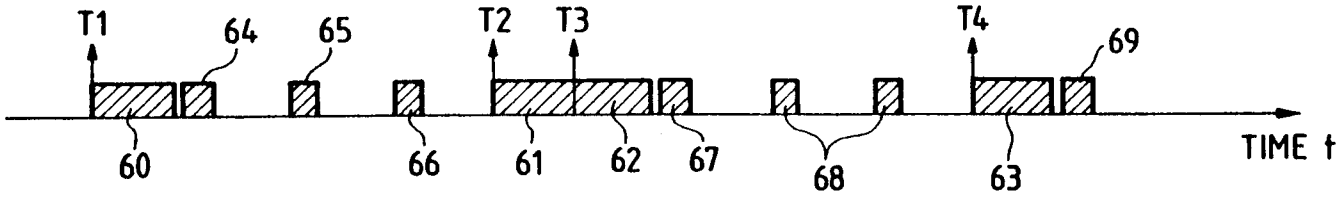
FIG. 6 is a timing chart showing timings of main recording processing and auxiliary recording processing in this embodiment.

FIG. 6 is a timing chart showing image recording timings of the facsimile apparatus of this embodiment.

Figure 7:
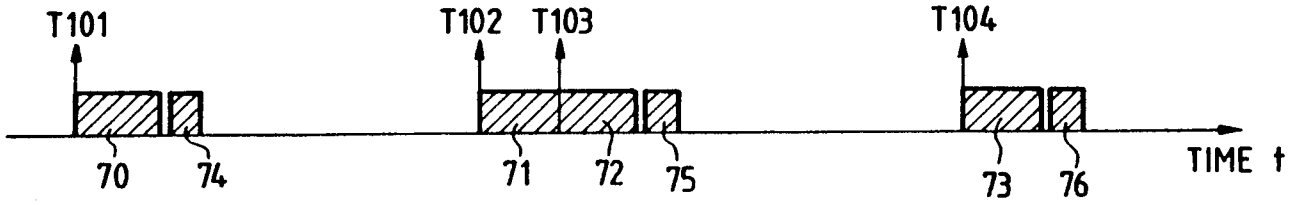
FIG. 7 PRIOR ART
FIG. 7 is a timing chart showing image recording timings of the prior art.

In FIG. 6, timings 60 to 63 indicate image recording timings of corresponding lines. Timings T1 to T4 indicate input timings of a print command for the next line and convey timings of the recording sheet 11 and the ink sheet 14 in steps S3 and S4 shown in FIG. 5. Timings 64, 67, and 69 indicate auxiliary heat timings executed in step S10 shown in FIG. 5 when a print start command for the next line is not input upon completion of recording for one line These timings also correspond to the conventional auxiliary heat timings shown in FIG. 7. Timings 65, 66, and 68 indicate auxiliary heat timings in this embodiment. When a time interval until the recording for the next line exceeds a predetermined period of time, the auxiliary heat operation is executed in a predetermined cycle until the print start command for the next line is input (step S16 in FIG. 5).

The auxiliary heat operation in this embodiment is performed to assist heat accumulation of the thermal head. However, the present invention is not limited to this. For example, an energy which is high enough to record data at the same position again may be applied, or a lower energy which does not cause recording may be applied. In the former case, the thermal head is heated using the same recording data as in the immediately preceding line. In the latter case, data is not limited to the same recording data as in the immediately preceding line. For example, the thermal head may be heated using all black data.

In the auxiliary heat mode, an energy may be adjusted not only by changing a pulse width to be energized but also by changing an application voltage.

As described above, according to this embodiment, when a recording interval exceeds a predetermined period of time, the thermal head is energized and heated in a predetermined cycle until the next recording operation is started. Thus, almost a constant heat accumulation state, or temperature, can be kept regardless of a recording cycle, and density nonuniformity of a recording image can be eliminated.

The auxiliary heat operation in this embodiment is effective in a recording apparatus such as a facsimile apparatus, in which an interval between image data for lines is nonuniform and is prolonged.

As described above, according to this embodiment, when no print start command for the next line is input upon completion of recording for a certain line, the thermal head is heated again for every predetermined period of time until the next recording operation is started. Thus, a decrease in temperature of the heat generating elements of the thermal head is suppressed, thereby eliminating recording density nonuniformity on the recording medium.

Second Embodiment (FIGS. 1 to 3, FIGS. 8 to 10)

In an embodiment to be described below, when a predetermined period of time ($\Delta T_1$) has passed after image recording, a thermal head is heated, and thereafter, when a predetermined period of time ($\Delta T_2$) has passed, the thermal head is heated again. This operation is repeated until the next recording operation is started. In this case, the predetermined periods of time are set to satisfy the relationship $\Delta T_n < \Delta T_{n+1}$ (n=1, 2, 3, . . . ).

In a description of the second embodiment, FIGS. 1 to 3 and their descriptions are quoted.

A convey mechanism of an ink sheet 13 and a recording sheet 11 will be described in detail below with reference to FIG. 8.

Figure 8:
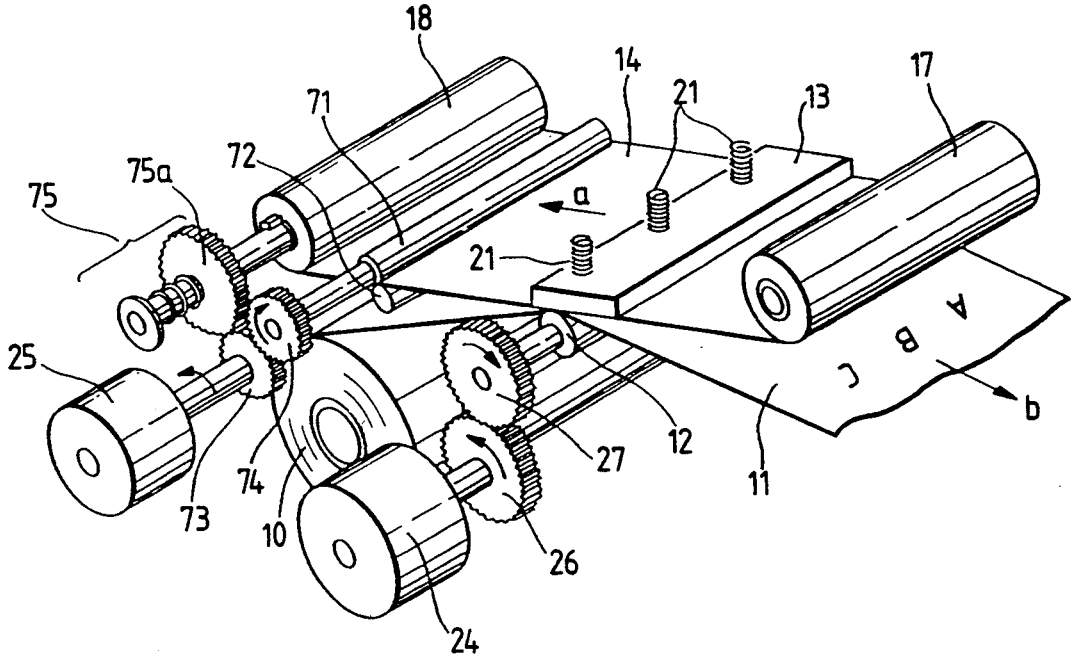
FIG. 8 is a perspective view showing a structure of a convey system of an ink sheet and a recording medium according to another embodiment of the present invention.

In FIG. 8, a motor 24 for conveying a recording sheet rotates a platen roller 12 to convey the recording sheet 11 in a direction of arrow b opposite to a direction of arrow a. A motor 25 is used to convey the ink sheet in the direction of the arrow a by a capstan roller 71 and pinch rollers 72. Transmission gears 26 and 27 transmit rotation of the motor 24 to the platen roller 12. Transmission gears 73 and 74 transmit rotation of the motor 25 to the capstan roller 71. In addition, the convey mechanism shown in FIG. 8 includes a sliding clutch unit 75.

The gear ratio of the gear 74 to the clutch unit 75 is set so that the length of the ink sheet 14 taken up by a take-up roller 18 upon rotation of a gear 75*a* is greater than the length of an ink sheet conveyed by the capstan roller 71. Thus, the ink sheet 14 conveyed by the capstan roller 71 is reliably taken up by the take-up roller 18. The difference between a take-up amount of the ink sheet 14 by the take-up roller 18 and a feed amount of the ink sheet 14 fed by the capstan roller 71 is absorbed by the sliding clutch unit 75. Thus, any variation in convey speed (amount) of the ink sheet 14 due to a variation in take-up diameter of the take-up roller 18 can be suppressed.

The recording operation of this embodiment will be described below with reference to FIG. 9.

Figures 9, 9A:
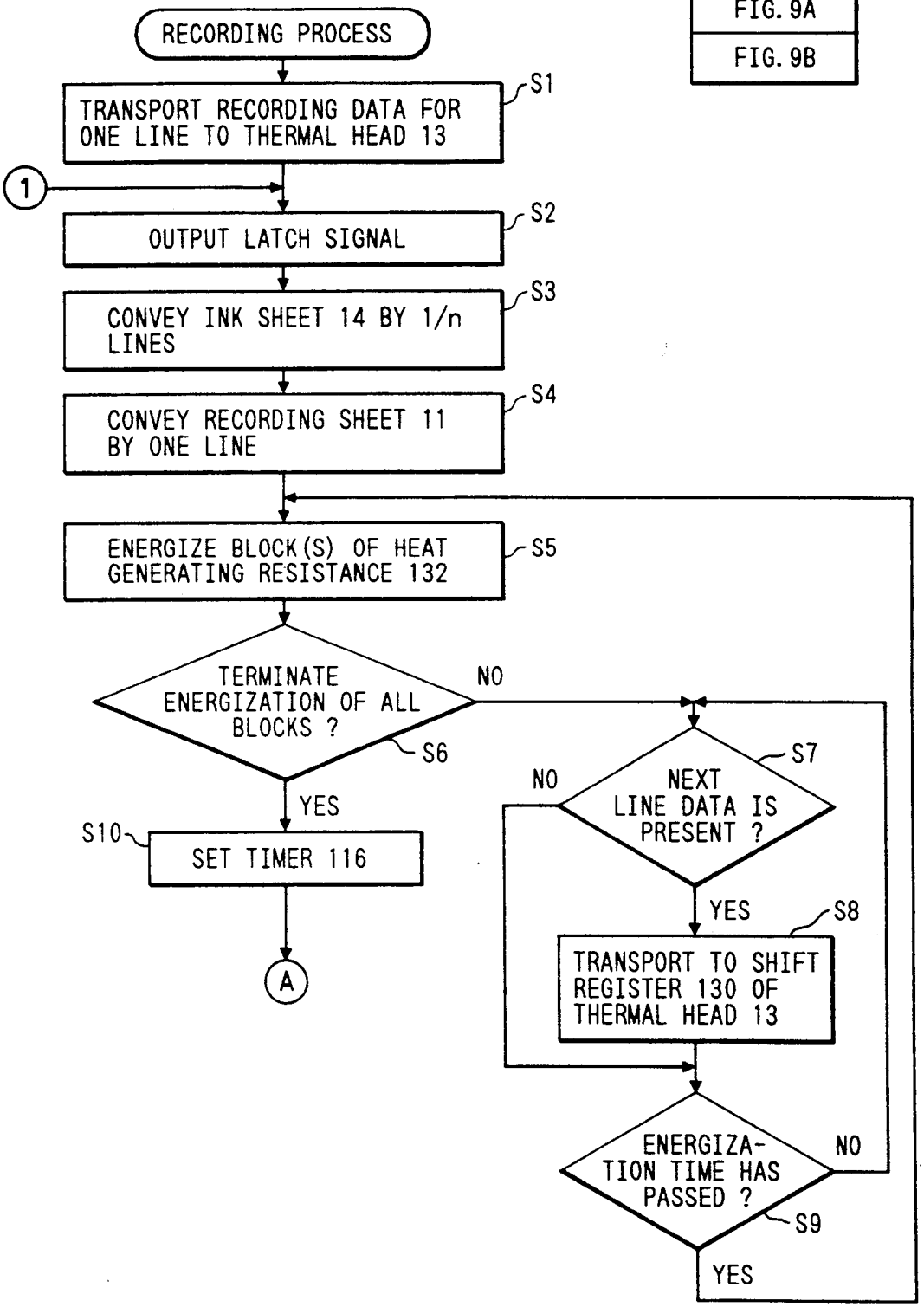
FIGS. 9A and 9B are a flow chart showing recording processing of the embodiment shown in FIG. 8.
Figure 9B:
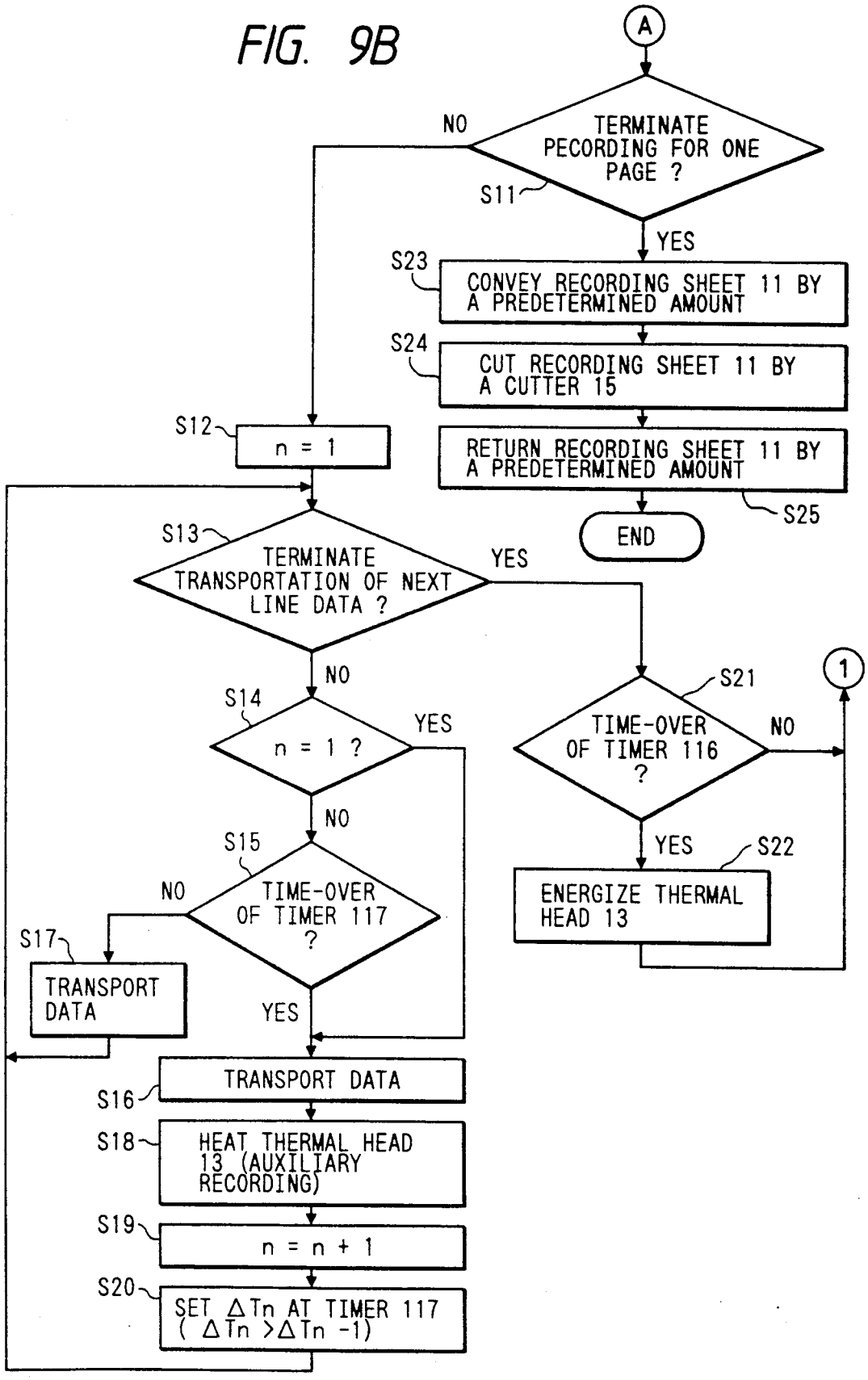

FIG. 9 is a flow chart showing recording processing for one page in the facsimile apparatus of this embodiment. A control program for executing this processing is stored in the ROM 114 of the control unit 101.

This processing is started when image data for one line is stored in the line memory 110 and the apparatus is ready to start a recording operation. In addition, the control unit 101 determines based on the switch 103*a* that the multi-ink sheet 14 is loaded.

In step S1, recording data for one line is serially output to the shift register 130. Upon completion of transportation of recording data for one line, a latch signal 44 is output in step S2 to store the recording data for one line in the latch 131. In step S3, the motor 25 is driven to convey the ink sheet 14 by 1/n lines. In step S4, the recording sheet 11 is conveyed by one line. The one-line length is set to be about (1/15.4) mm in the facsimile apparatus of this embodiment. Convey amounts of the recording sheet 11 and the ink sheet 14 can be respectively set by changing energization pulse counts of the motors 24 and 25.

In step S5, one of blocks of the heat generating resistor 132 is energized to record an image, and it is checked in step S6 if energization of all the blocks is completed. If NO in step S6, the flow advances to step S7 to check if recording data for the next line is ready. If YES in step S7, the flow advances to step S8, and the recording data for the next line are sequentially transported to the shift register 130 of the thermal head 13. During data transportation to the thermal head 13, it is checked in step S9 if an energization time of one block has passed. If it is determined in step S9 that the energization time (about 600 μs) does not pass, the flow returns to step S7; otherwise, the flow returns to step S5 to execute energization processing for the next block. In this embodiment, the thermal head 13 is divided into four blocks, and is energized in units of these blocks. A time required for recording for one line is about 2.5 ms (600 μs×4 blocks).

If it is determined in step S6 that energization of all the blocks is completed and recording for one line is completed, the flow advances to step S10, and a predetermined time (in this case, 20 ms) is set in the time 116 to start measurement of time by the timer 116. The flow then advances to step S11 to check if image recording for one page is completed. If NO in step S11, a heat generation count n of the thermal head 13 is set to be an initial value, i.e., 1 in step S12, and the flow advances to step S13 to check if all the image data for the next line are transported to the shift register 130 of the thermal head 13. If NO in step S13, it is checked in step S14 if the thermal head 13 performs the first heat generation operation after a recording operation, i.e., if n=1. If NO in step S14, the flow advances to step S15 to check if the timer 117 is time-over. If YES in step S15, data are transported in step S17, and the flow then returns to step S13. If it is determined in step S14 that n=1 or if it is determined in step S15 that the timer 117 is time-over, the flow advances to step S16, and data are transported. In step S18, the thermal head 13 is heated using the same data, and is incremented by one in step S19 to indicate that the thermal head 13 is heated. In this embodiment, the thermal head 13 is heated using the same data but the same data need not be used. The flow advances to step S20, and a new predetermined time $\Delta T_n$ is set in the timer 117. $\Delta T_n$ is a longer than the immediately preceding predetermined time $\Delta T_{n-1}$ ($\Delta T_n > \Delta T_{n-1}$).

In this manner, when a time until the next recording is prolonged, ink temperature can be prevented from being decreased, which would otherwise interfere with separation of the ink sheet and the recording sheet. Intervals between adjacent after heat operations are sequentially prolonged to prevent heat accumulation of the head.

Upon completion of step S20, the flow returns to step S13.

After image data for the next line to be recorded are transported to the thermal head 13 in step S13, the flow advances to step S21 to check if the timer 116 is time-out, e.g., 20 ms have passed. If NO in step S21, the flow returns to step S2, and the recording data for the next line are latched in the latch 131. The above-mentioned image recording processing is then executed.

However, if YES in step S21, the flow advances to step S22, and the thermal head 13 is energized in units of blocks. In this case, since data in the latch 131 of the thermal head 13 are equal to the immediately preceding image data for one line which have been recorded, the same image data is recorded again. Since energization processing to the thermal head 13 in step S22 is executed after the recording data for the next line are transported to the shift register 130 of the thermal head 13, it is executed at a timing immediately before recording processing for the next line. As a result, this processing also serves as a pre-heat operation for the thermal head 13. The "timing immediately before the next recording processing" corresponds to a delay time by the processing time in steps S22 to S5. An energization time of the thermal head 13 in step S22 may be the same as that in step S5 or may be shorter than it.

Upon completion of image recording for one page in step S11, the flow advances to step S23, and the recording sheet 11 is conveyed toward discharge rollers 16*a* and 16*b* by a predetermined length. In step S24, cutters 15*a* and 15*b* are driven to mesh with each other, thereby cutting the recording sheet 11 into a page. In step S25, the motor 24 is reversed to return the recording sheet 11 by a distance corresponding to an interval between the thermal head 13 and the cutter 15, thus executing cutter processing of the recording sheet 11.

In this manner, according to the present invention, every time a recording operation for each line is completed, an auxiliary recording operation for recording the same data again is executed. When a time interval until recording for the next line exceeds a predetermined period of time, the thermal head 13 is heated again in step S22, thereby improving image recording quality, and decreasing the shearing strength of the ink components in an ink layer, so that the ink sheet 14 can be easily separated from the recording sheet 11 during convey of the ink sheet 14 and the recording sheet 11 in steps S3 and S4. In step S20, a predetermined period of time to be set in the timer 117 is increased, thus preventing heat accumulation on the thermal head 13.

When the thermal head 13 is driven in steps S18 and S22, an application energy to the heat generating element 132 may be decreased to be smaller than that in an actual recording mode. When the thermal head is driven in step S22, the same recording data as in the immediately preceding line is used, and the heat generating resistor 132 corresponding to some black dots are energized to prevent solidification of the ink.

Figure 10:
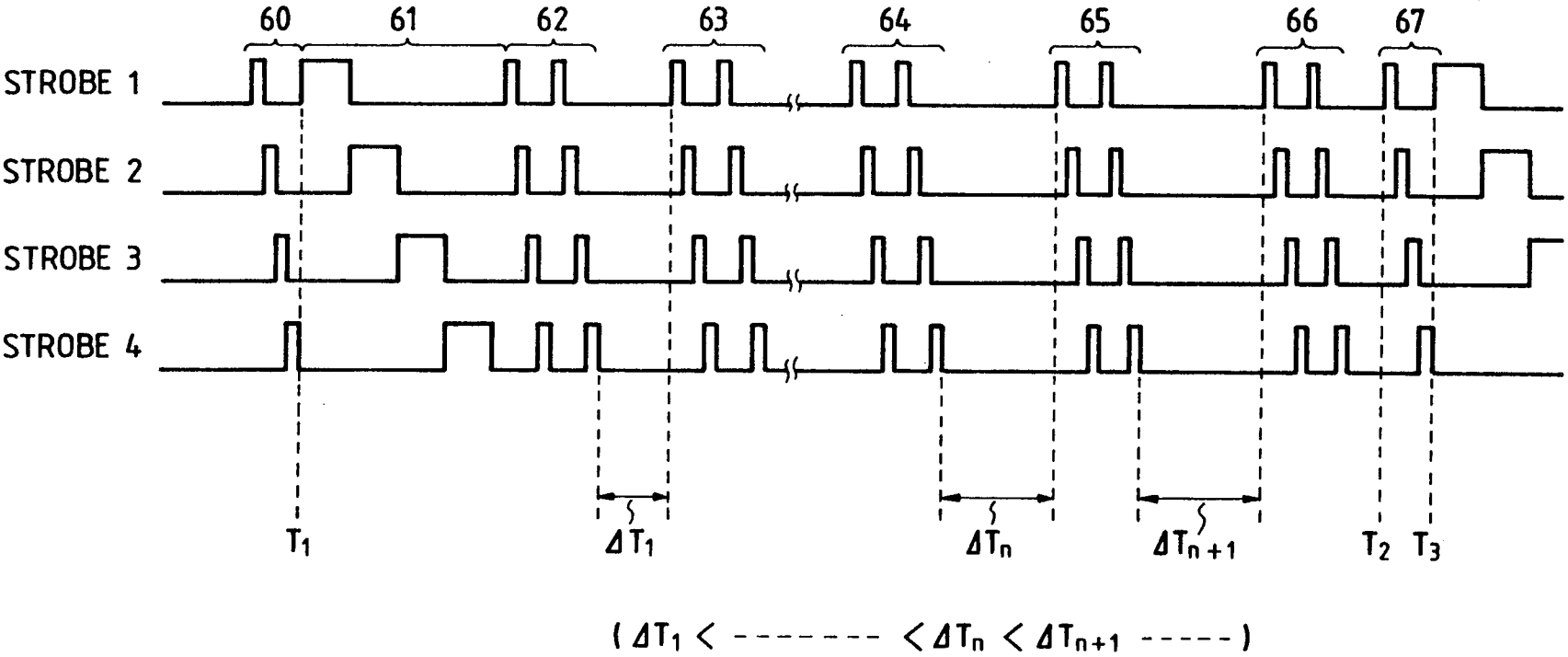
FIG. 10 is a timing chart showing energization timings of a thermal head in recording processing of the embodiment shown in FIG. 8.

FIG. 10 is a timing chart showing energization timings of the thermal head 13 in the image recording processing of this embodiment. In this embodiment, the heat generating resistor 132 of the thermal head 13 are energized while being divided into four blocks. Strobe signals 1 to 4 correspond to energization signals of the four blocks of the heat generating resistor 132.

In FIG. 10, a time interval 60 indicates an actual energization time of the thermal head 13 executed in step S22 immediately before actual recording processing 61. A timing $T_1$ indicates a timing at which all the recording data for the next line are transported to the thermal head 13, and the recording for the next line is ready. After recording for one line is executed during time interval 61, an auxiliary recording operation is executed twice during a time interval 62 (step S18). If a time elapsed after the auxiliary recording operation during the time interval 62 reaches $\Delta T_1$, energization during a time interval 63 for heating the thermal head 13 in step S18 is executed. Upon completion of energization during the time interval 63, the next predetermined time is set in the timer 117. When the timer 117 is time-out, energization during the time interval 63 is executed again. This processing is repeated until recording data for the next line are transported to the thermal head 13 and recording for the next line is ready at a timing $T_2$.

A time $\Delta T_n$ from the end of energization during a time interval 64 to the beginning of energization during a time interval 65, and a time $\Delta T_{n+1}$ from the end of energization during the time interval 65 to the beginning of energization during a time interval 66 always have the relation $\Delta T_n < \Delta T_{n+1}$ (n=1, 2, . . . ). Thus, the head 13 can be prevented from heat accumulation, and excessive temperation by repetitive energization. In this embodiment, for example, $\Delta T_1$ is set to be 5 ms, and an after heat (auxiliary recording) interval is prolonged every ms. Therefore, we have:

$$\Delta T_1 = 5 \text{ ms}$$

$$\Delta T_{n+1} - \Delta T_n = 1 \text{ ms}$$

At timings $T_1$ and $T_3$, the excitation phase of the motor 24 is switched, thus conveying the recording sheet 11 by one line (step S4).

The energization times of the blocks of the thermal head 13 during these time intervals 60, 62, 63, 64, 65, 66, and 67 are about ¼ of the energization time 61 in the actual recording mode.

According to the present invention, the same data is recorded again after recording is completed, and when a recording time interval until the beginning of the next recording exceeds a predetermined period of time, the image of the line is recorded again immediately before the next recording processing. As a result, a sufficient image density can be obtained, and image recording quality can be improved. In addition, easy separation between the ink sheet and the recording sheet is achieved.

This embodiment is particularly effective in a recording apparatus such as a facsimile apparatus, in which an interval between image data for lines is nonuniform and is prolonged.

As described above, according to this embodiment, the same data is recorded after recording while the recording medium stands still. When a time until the next recording operation is long, a recording means is driven after a lapse of a predetermined period of time, thereby improving recorded image quality, and allowing easy separation of the ink sheet and the recording medium. In addition, the predetermined time is prolonged ($\Delta T_{n-1} < \Delta T_n$), thus preventing heat accumulation in the recording medium.

Third Embodiment (FIGS. 2 to 3, FIG. 8, FIGS. 11 to 15)

In an embodiment to be described below, a recording means is controlled to be heated based on all black data or data having a predetermined black ratio (the energy to be applied to each block of a head by a pre-heat operation is the same if either data is selected) without conveying a recording medium after image recording by the recording means. After image recording by the recording means, the recording means is driven while changing pre-heat data according to the recording cycle (a black ratio is decreased when a recording cycle is short) without conveying a recording medium.

In a description of the third embodiment, FIGS. 1 to 3 and FIG. 8 and their descriptions are quoted.

Figure 11:
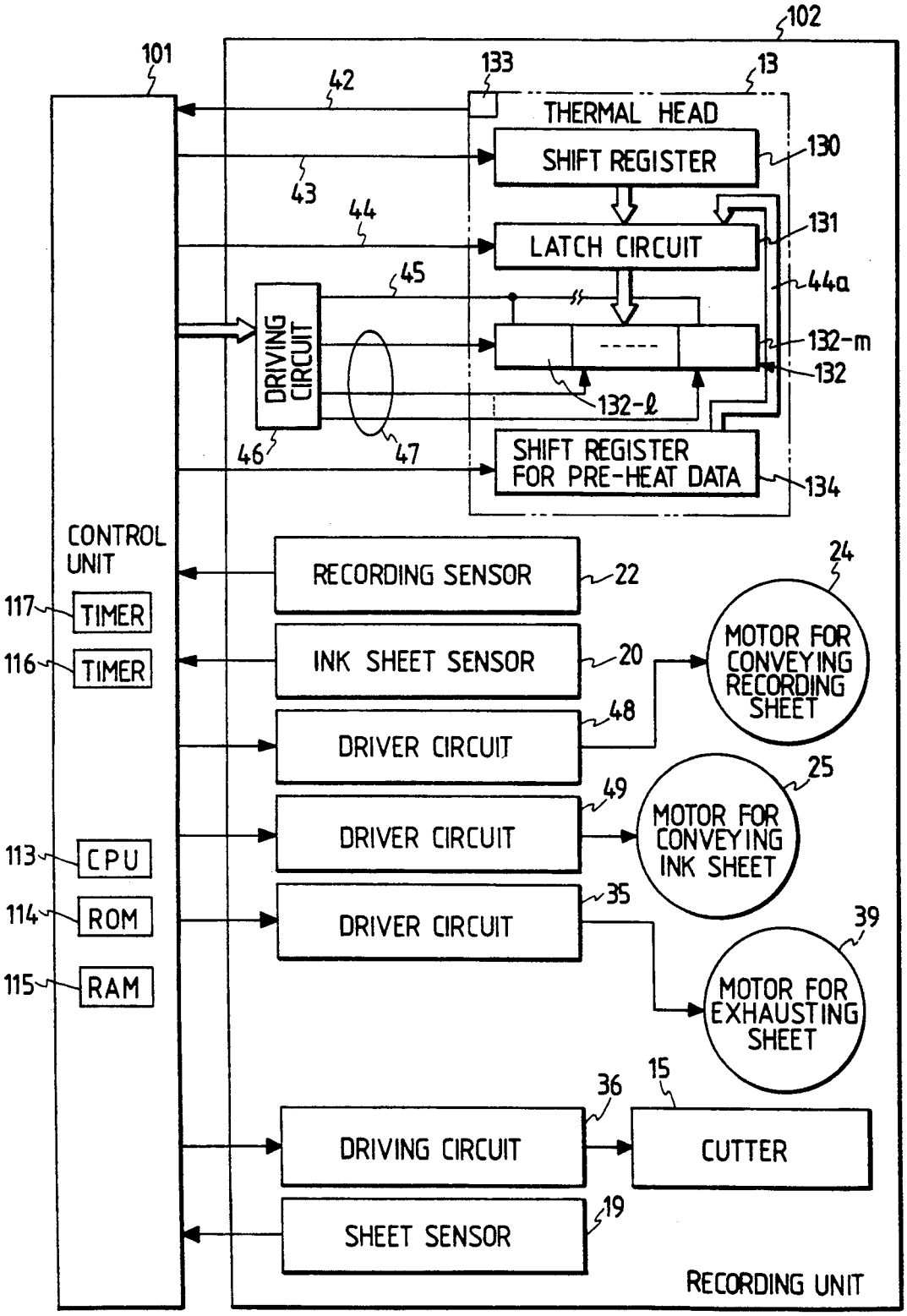
FIG. 11 is a block diagram showing electrical connections between a control unit and a recording unit according to still another embodiment of the present invention.

Electrical connections between a control unit and a recording unit of this embodiment will be described below with reference to FIG. 11. The same reference numerals in FIG. 11 denote the same parts as in FIG. 1, and a description thereof is quoted. Thus, only differences will be described below.

In this embodiment, the thermal head 13 comprises a shift register 130 for receiving serial recording data for one line and a shift clock 43, a pre-heat data shift register 134 for receiving pre-heat data, a latch 131 for latching data of the shift register 130 in response to a true latch signal 44, and for latching data of the pre-heat data shift register 134 in response to a pre-latch signal 44*a*, and a heat generating element 132 comprising a plurality of heat generating resistors for one line.

The recording operation of this embodiment will be described below with reference to FIG. 12.

Figure 12A:
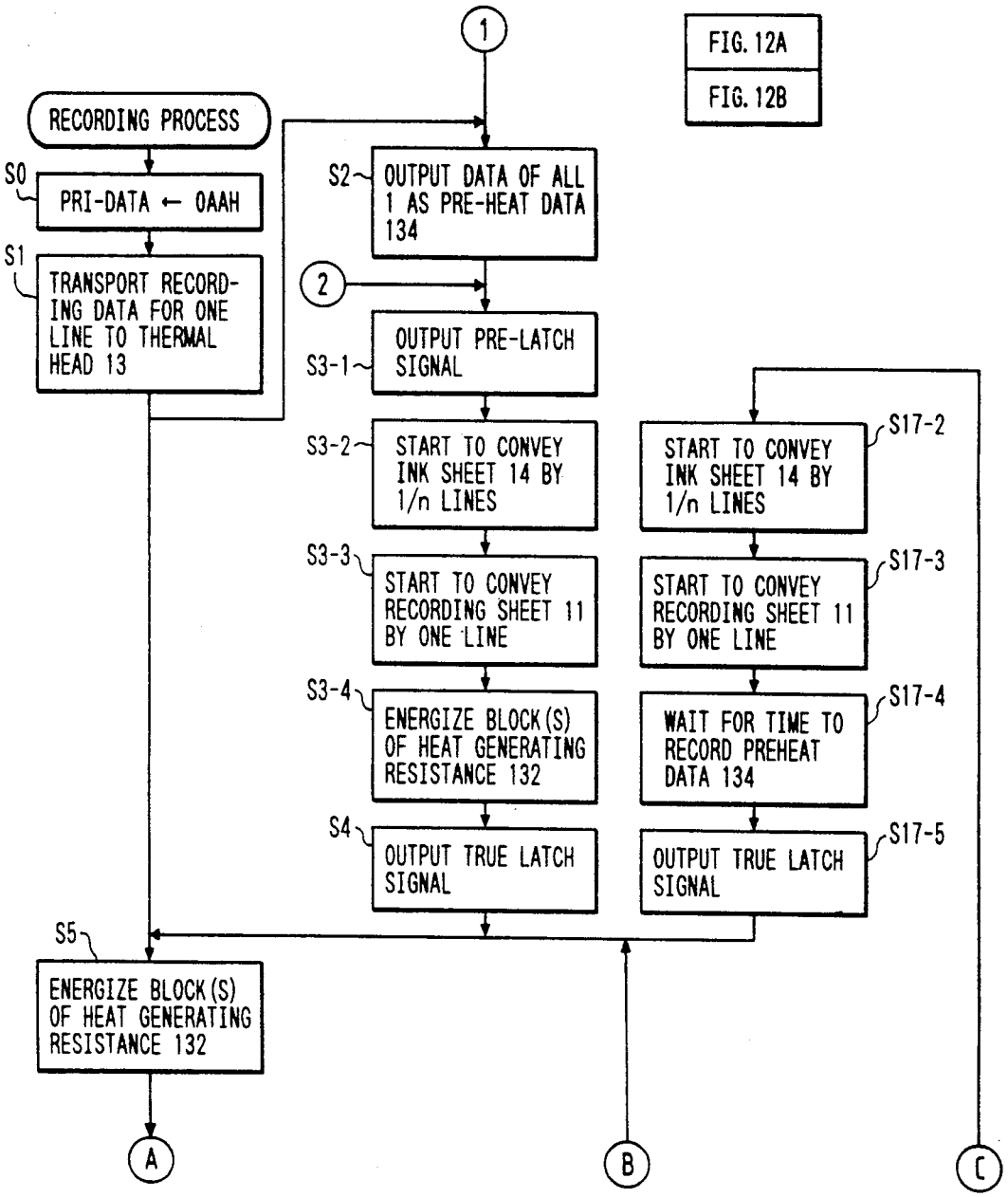
FIGS. 12A and 12B are flow charts showing recording processing of the embodiment shown in FIG. 11.
Figure 12B:
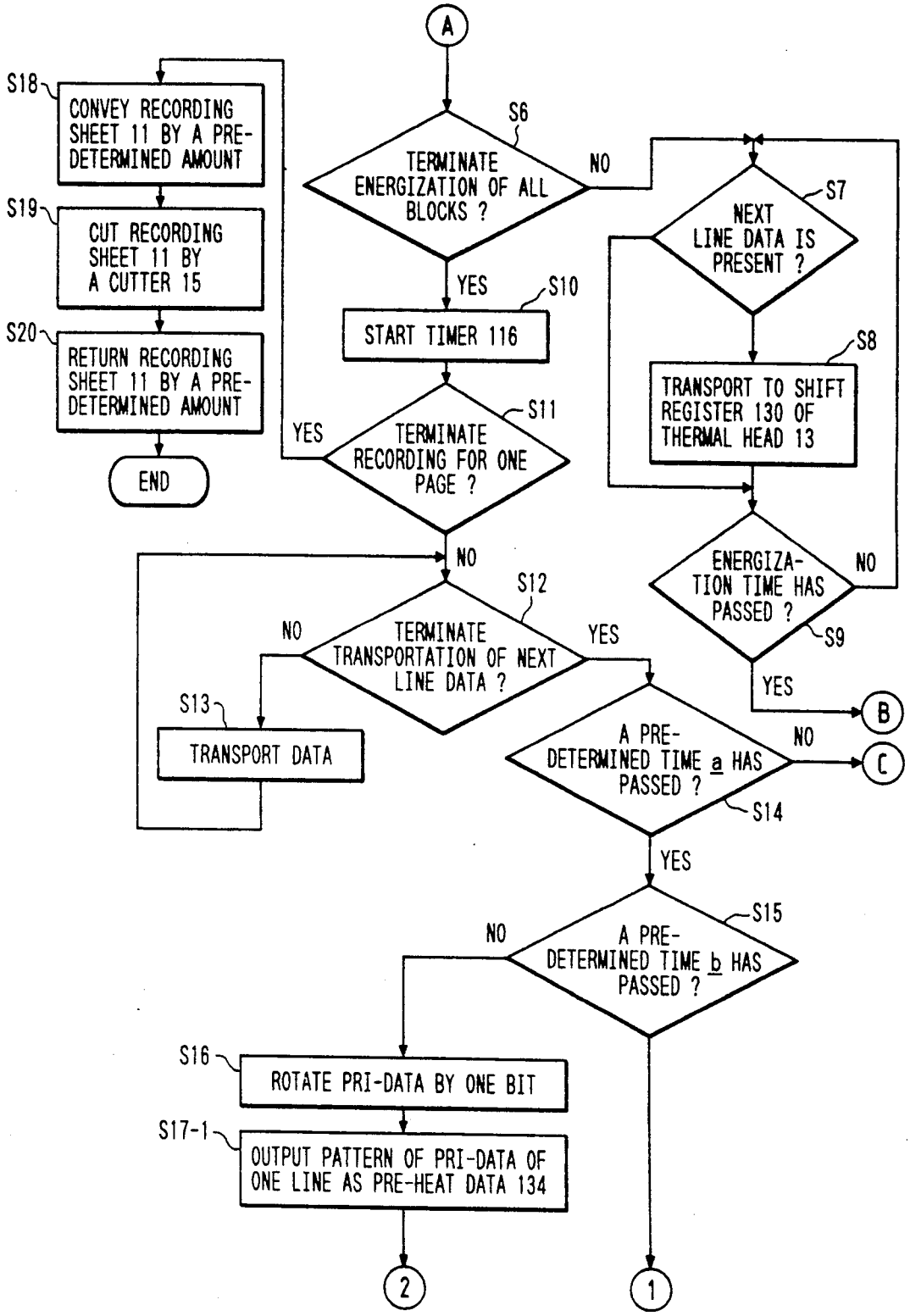

FIG. 12 is a flow chart showing recording processing for one page in the facsimile apparatus of this embodiment. A control program for executing this processing is stored in the ROM 114 of the control unit 101.

This processing is started when image data for one line is stored in the line memory 110 and the apparatus is ready to start a recording operation. In addition, the control unit 101 determines based on the switch 103*a* that the multi-ink sheet 14 is loaded.

Control using this embodiment will be briefly described below.

In this embodiment, when data transportation for the next line is completed within a predetermined time a after completion of an actual recording operation, no pre-heat operation is executed, and recording for the next line is started after the lapse of a time until the motors are started after the phases of the motors for conveying the recording sheet and the ink sheet are switched. After the actual recording operation is completed, when data transportation for the next line is completed within a predetermined time b after the lapse of the predetermined time a, a pre-heat operation is started alternately using data ϕAAH and ϕ55H as pre-heat data after the phases of the motors for conveying the recording sheet and the ink sheet are switched. The control waits after the pre-heat operation is completed until the motors are started (in this embodiment, a wait time is assumed to be zero), and then starts recording for the next line. When data transportation for the next line is completed the lapse of the predetermined time b from the end of the actual recording operation, a pre-heat operation is performed using all "1" (all black) data as pre-heat data after the phases of the motors for conveying the recording sheet and the ink sheet are switched. The control waits after the pre-heat operation is completed until the motors are started (in this embodiment, a wait time is assumed to be zero), and then starts recording for the next line.

In this embodiment, pre-heat data is changed according to a time after the actual recording operation is completed until the end of data transportation for the next line. More specifically, when a time until the end of data transportation for the next line is long, the black ratio of the pre-heat data is increased. A pre-heat width is fixed.

In this embodiment, when a time until the end of data transportation for the next line is equal to or shorter than a predetermined time, no pre-heat operation is executed. When this time is equal to or longer than a and shorter than b, pre-heat data having a black ratio of 50% is used. When this time exceeds b, pre-heat data having a black ratio of 100% is used. An energy applied to each dot by the pre-heat operation at the black ratio of 50% can be the same by repetitively using data ϕAAH and ϕ55H. More specifically, the pre-heat data are cyclically used, so that an energy applied to each dot of the heat by the pre-heat operation can be identically controlled.

In this embodiment, the black ratio is changed to 0%, 50%, and 100% but additional or different black ratio values may be used.

Figure 13:
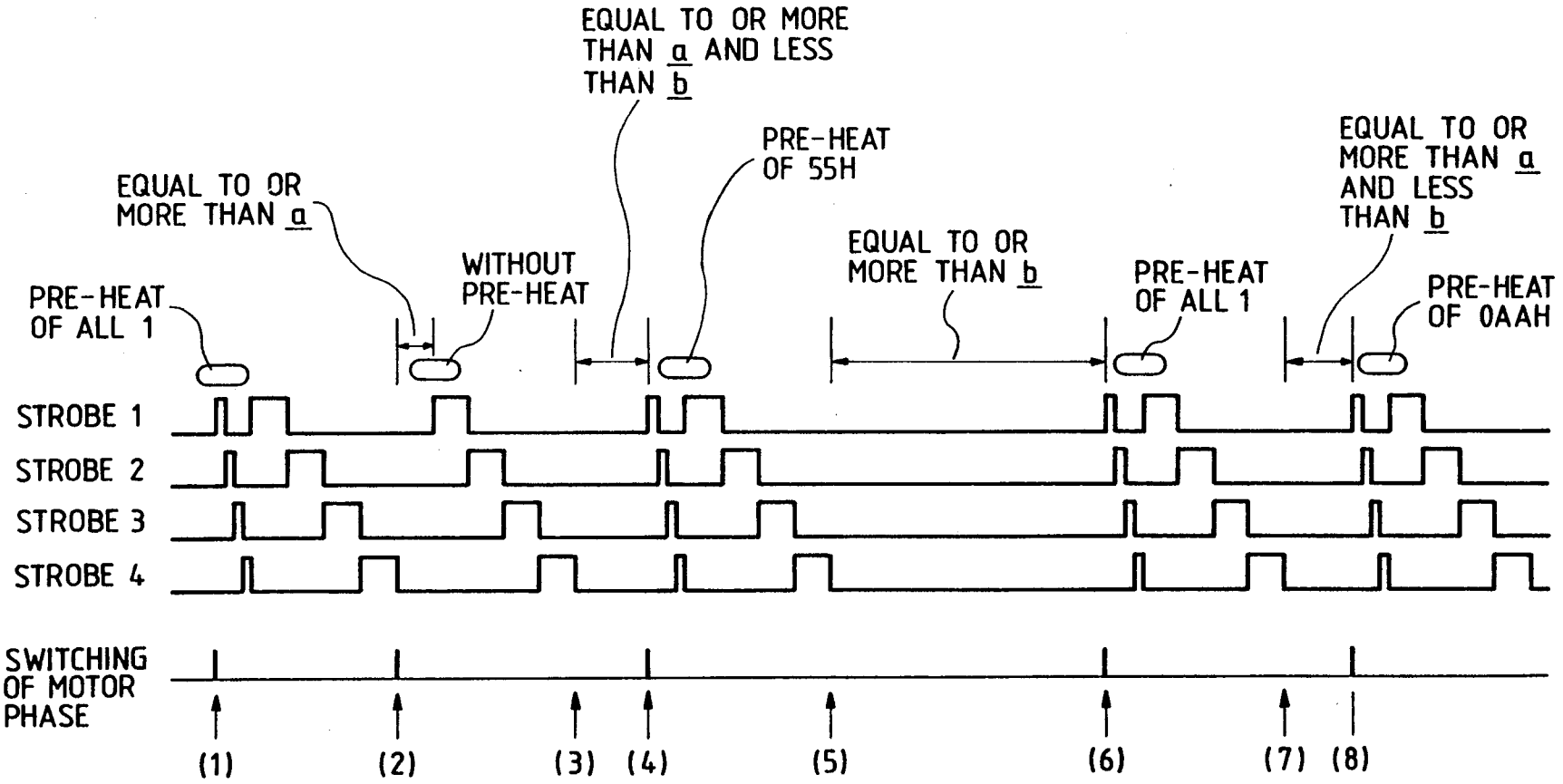
FIG. 13 is a timing chart showing energization timings of a thermal head in the recording processing of the embodiment shown in FIG. 11.

FIG. 13 shows switching of motor phases and strobe waveforms. At a timing (1), phases of the motors for the recording sheet and the ink sheet are switched. Then, a pre-heat operation using all "1" data is performed. Thereafter, at a timing (2), an actual recording operation is executed. Upon completion of the actual recording operation (timing (2)), since data transportation for the next line has been completed (a time required until the end of data transportation for the next line from the end of the actual recording operation is equal to or shorter than the predetermined time a), the actual recording operation is executed without performing the pre-heat operation. Since data transportation is completed (timing (4)) within a time equal to or longer than the predetermined time a and shorter than the predetermined time b after the actual recording operation is completed (timing (3)), the pre-heat operation is performed using data 55H and then, the actual recording operation is performed. Since data transportation for the next line is completed after the lapse of the predetermined time b or more (timing (6)) from the end of the actual recording operation (timing (5)), the pre-heat operation is performed using all "1" (all black) data, and the actual recording operation for the next line is executed. Since data transportation is completed within a time equal to or longer than the predetermined time a and shorter than the predetermined time b after the actual recording operation is completed (timing (8)), the pre-heat operation is performed using data AAH.

Figure 15A:
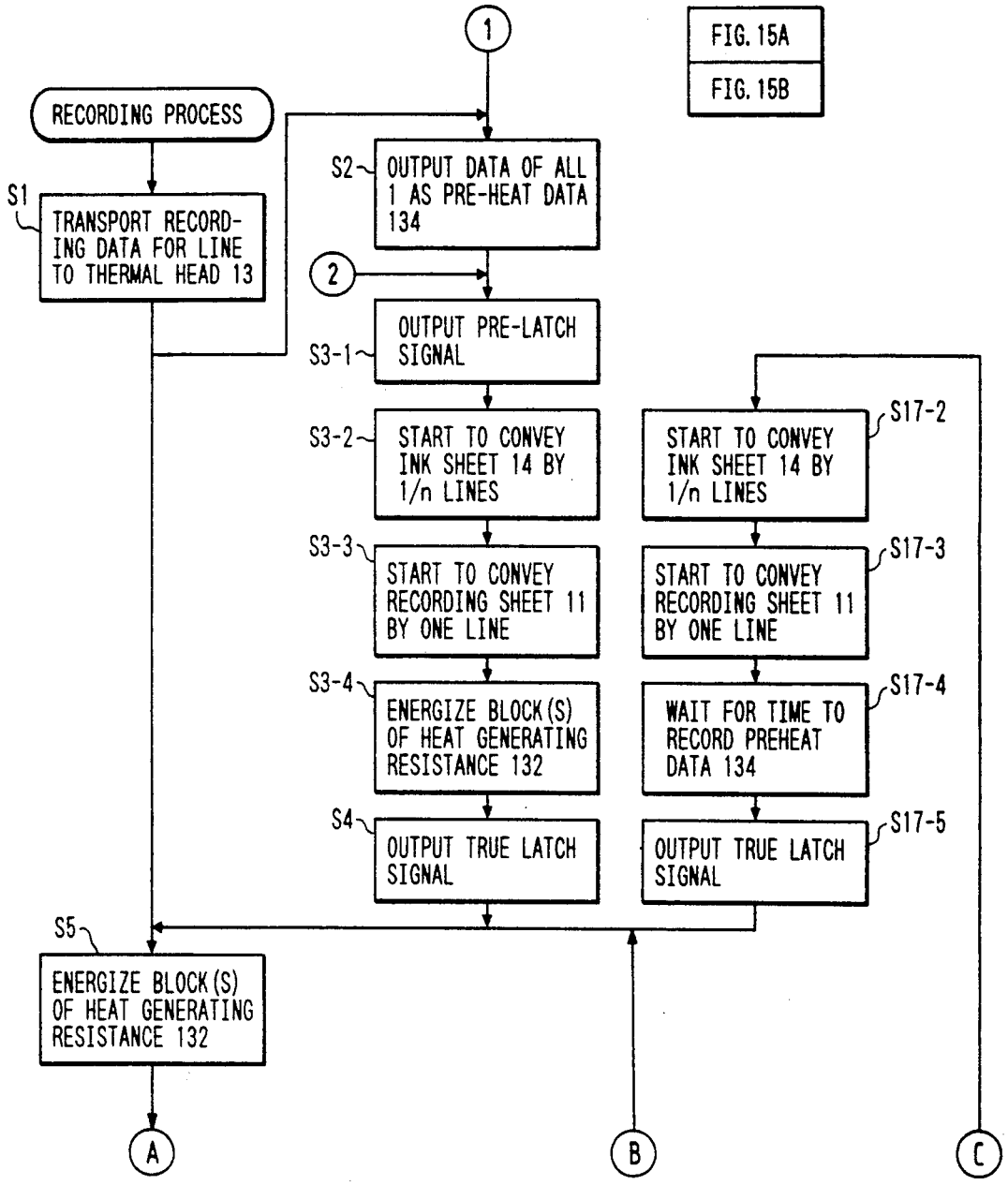
FIGS. 15A and 15B are flow charts showing recording processing according to still another embodiment of the present invention.
Figure 15B:
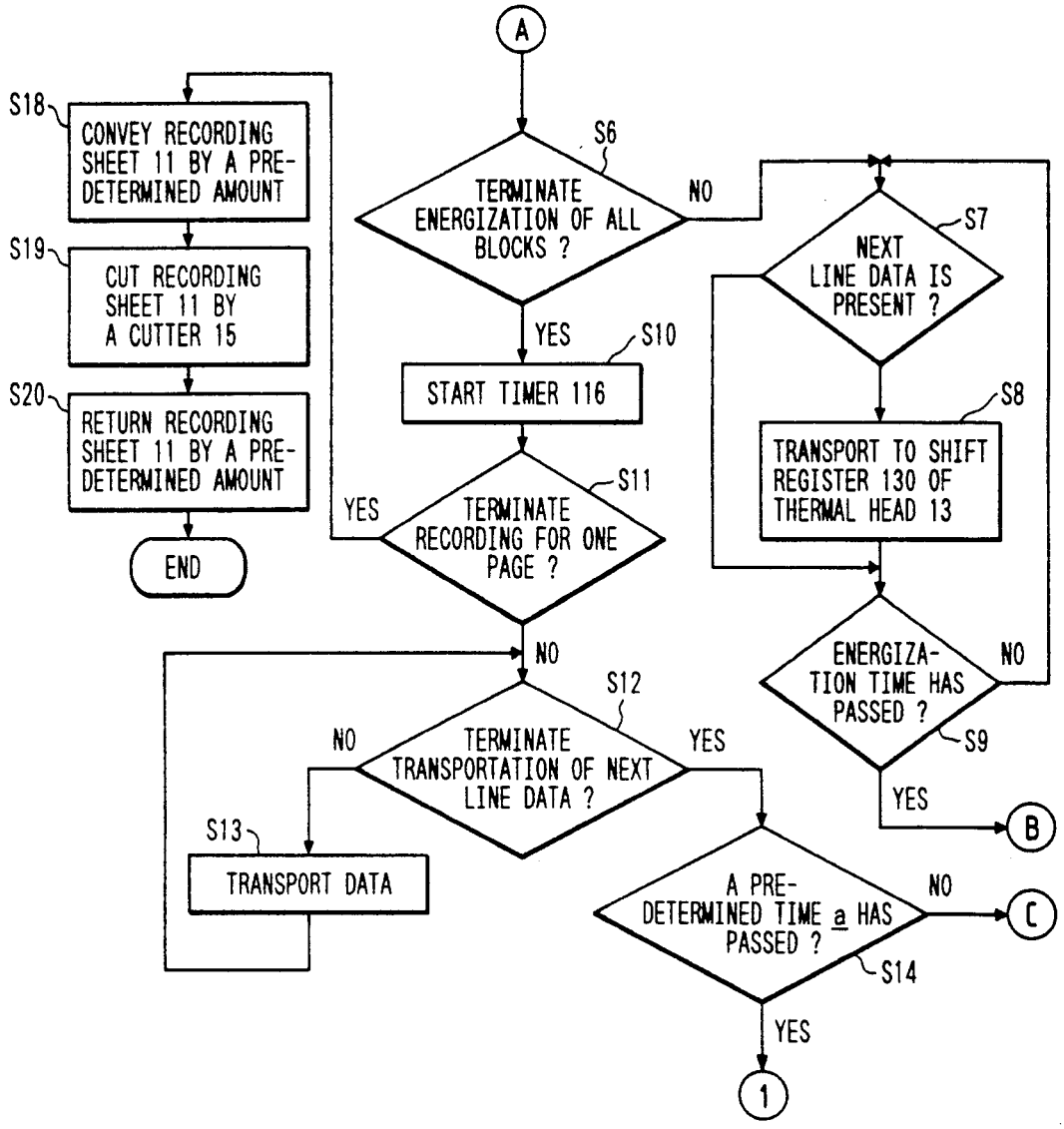

In the above embodiment, the pre-heat data is changed according to a time from the end of the actual recording operation until the end of data transportation for the next line, all "1" (all black) data may be used for all the above cases. When recording using data of the immediately preceding line as pre-heat data is performed, sticking can be suppressed. This control example is shown in FIG. 15 (in this control, steps S0, S15, S16, and S17-1 are omitted from FIG. 12). However, as for reproduction of an isolated point, an energy must be increased at the isolated point. Since information of the immediately preceding line of the isolated point is white, it is not effective to record the preceding line as pre-eat data. From these two viewpoints, it is often preferable that all black information is energized immediately before actual recording to perform the pre-heat operation. Energization of all black information aims to keep a temperature constant, and uses energy insufficient to cause recording. In the pre-heat mode, the recording sheet and the ink sheet stand still, and ink is not inadvertantly transferred to the recording sheet.

Figure 14:
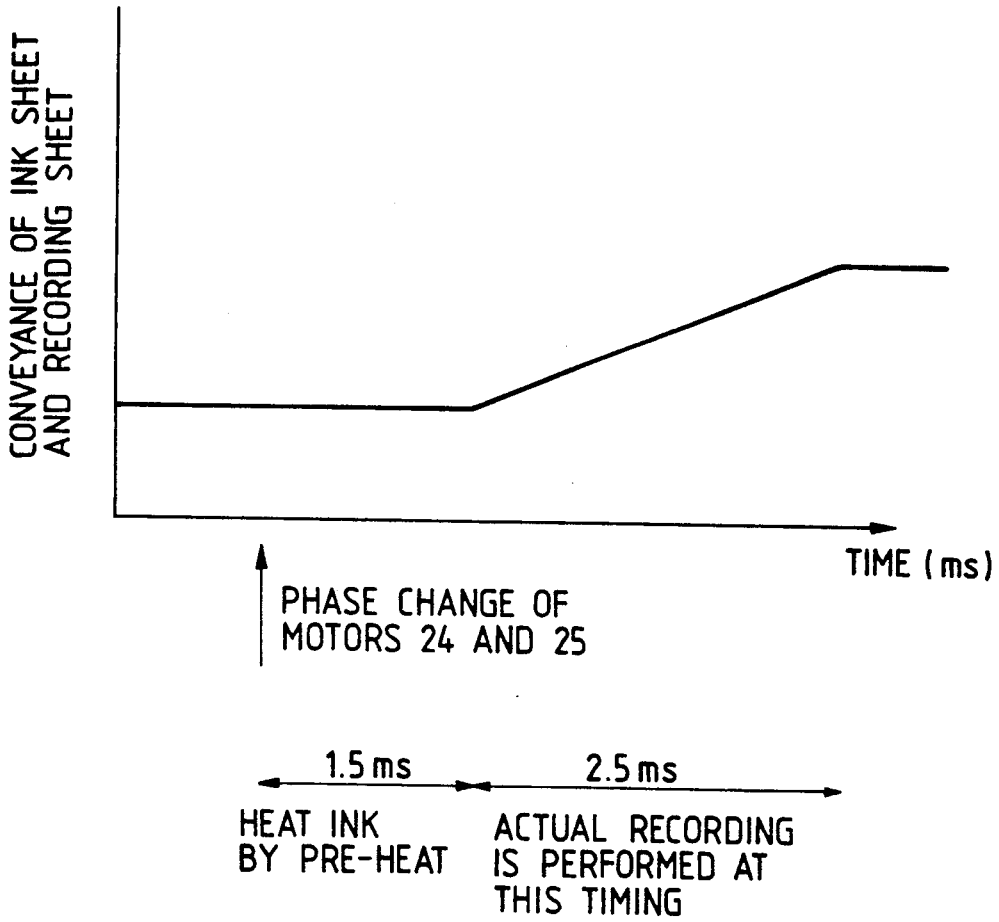
FIG. 14 is a graph showing the relationship between phase changes of motors, and convey operations of a recording medium and an ink sheet.

According to this embodiment, the actual recording operation is performed at a timing when the motors are started in practice after the phases of the motors for conveying the recording sheet and the ink sheet are switched. According to the recording method of this embodiment, melted ink (or sublimated ink depending on a type of ink) is transferred to a recording sheet when it contacts the recording sheet. Therefore, ink can be more efficiently transferred by performing a moving write operation (recording). When a recording interval after the motor phases are switched exceeds a predetermined period of time (e.g., 10 ms or more), the thermal head 13 is heated to perform a pre-heat operation, and an ink is heated during this interval. The actual recording is started from a timing at which the recording sheet and the ink sheet are started to be conveyed, thereby performing efficient transfer. The control of this embodiment has been briefly described. FIG. 14 shows switching of the motor phases, conveyance of recording sheet and the ink sheet, and actual recording timings. In the embodiment shown in FIG. 14, a pre-heat operation is performed for 1.5 ms by the thermal head 13 after the phases of the motors 24 and 25 are switched, and thereafter, an actual recording operation is performed for 2.5 ms.

In step S0, data 134 used for the pre-heat operation is stored in a register PRI-DATA when a time until the end of transportation for the next line is equal to or longer than the predetermined time a and shorter than the predetermined time b after the completion of the actual recording operation. In this embodiment, the predetermined time a is set to be 5 ms, and the predetermined time b is set to be 10 ms.

In step S1, recording data for one line are serially transported to the shift register 130. Upon completion of transportation of recording data for one line, all "1" data is transferred to the pre-heat data shift register in step S2. In step S3-1, the pre-latch signal 44*a* is output to store the pre-heat data 134 for one line in the latch 131. In step S3-2, the motor 25 is driven to convey the ink sheet 14 by 1/n lines. In step S3-3, the recording sheet 11 is conveyed by one line. The one-line length is set to be about (1/15.4) mm in the facsimile apparatus of this embodiment, and convey amounts of the recording sheet 11 and the ink sheet 14 can be respectively set by changing energization pulse counts of the motors 24 and 25. In step S3-4, blocks of the heat generating resistors 132 are energized. The energization time of each block is set to be, e.g., 0.2 ms. Upon completion of energization of the four blocks, the flow advances to step S4, and the true latch signal 44 is output to cause the latch 131 to store recording data for one line.

In step S5, one block of the heat generating resistors 132 is energized to record an image. It is then checked in step S6 if all the blocks of the thermal head 13 is energized. If NO in step S6, the flow advances to step S7 to check if recording data for the next line is ready. If YES in step S7, the flow advances to step S8, and the recording data for the next line are sequentially transported to the shift register 130 of the thermal head 13. During data transportation to the thermal head 13, it is checked in step S9 if an energization time of one block has passed. If it is determined in step S9 that the energization time (about 600 μs) does not pass, the flow returns to step S7; otherwise, the flow returns to step S5 to execute energization processing for the next block. In this embodiment, the thermal head 13 is divided into four blocks, and is energized in units of these blocks. A time required for recording for one line is about 2.5 ms (600 μs×4 blocks).

If it is determined in step S6 that energization of all the blocks is completed and recording for one line is completed, the flow advances to step S10, and time measurement of the timer 116 is started. The flow advances to step S11 to check if image recording for one page is completed. If NO in step S11, the flow advances to step S12 to check if all the image data for the next line are transported to the shift register 130 of the thermal head 13. If NO in step S12 and if it is determined in step S13 that the data for the next line is ready, data transportation processing for transporting data to the thermal head 13 is executed.

After the image data for the next line to be recorded are transported to the thermal head 13 in step S12, the flow advances to step S14 to check if the predetermined time a has passed in the timer 116. If NO in step S14, the flow advances to step S17-2, and the motor 25 is driven to convey the ink sheet 14 by 1/n lines. In step S17-3, the recording sheet 11 is conveyed by one line. In step S17-4, the control waits until the motors 24 and 25 are started. In step S17-5, the true latch signal 44 is output to cause the latch 131 to store recording data for one line.

However, when the predetermined time a has passed, the flow advances to step S15 to check if the predetermined time b has passed. If YES in step S15, the flow advances to step S2; otherwise, the PRI-DATA is rotated by one bit (step S16), and a pattern of PRI-DATA for one line is output as the pre-heat data 134 (step S17-1).

Upon completion of image recording for one page in step S11, the flow advances to step S18, and the recording sheet 11 is conveyed toward the discharge rollers 16*a* and 16*b* by a predetermined amount. In step S19, the cutters 15*a* and 15*b* are driven to mesh with each other, thereby cutting the recording sheet 11 into a page. In step S20, the motor 24 is reversed to return the recording sheet 11 by a distance corresponding to an interval between the thermal head 13 and the cutter 15, thus executing cutter processing of the recording sheet 11.

In this manner, according to this embodiment, since the thermal head 13 is heated after the lapse of a predetermined period of time from switching of phases of the motors 24 and 25 for conveying the ink sheet and the recording sheet, transfer efficiency of an ink onto the recording sheet 11 can be further increased.

As described above, according to this embodiment, in a thermal transfer printer, since a delay time is set after the phases of the motors for the recording sheet and the ink sheet are switched until the motors are started, an ink is heated during this interval, and the actual recording is started at a timing when the ink sheet begins to move, thus allowing efficient transfer.

According to this embodiment, in a thermal transfer printer, when a recording time interval until the beginning of the next recording exceeds a predetermined period of time after completion of recording, a recording means is driven using all black pre-heat data. Thus, sticking of the ink sheet is prevented, and an isolated point can be clearly recorded. As a result, image recording quality can be improved, and easy separation between, the ink sheet and the recording sheet can be achieved.

According to this embodiment, a black ratio of pre-heat data is changed according to a recording time until the beginning of the next recording after completion of recording (a black ratio is increased when the period is long), thus preventing heat accumulation.

This embodiment is particularly effective in a recording apparatus such as a facsimile apparatus, in which an interval between image data for lines is nonuniform and is prolonged.

As described above, according to this embodiment, since a pre-heat operation is performed immediately before a recording operation, sticking between an ink sheet and a recording medium can be eliminated, an isolated point can be clearly recorded, and image recording quality can be improved.

Figure 16:
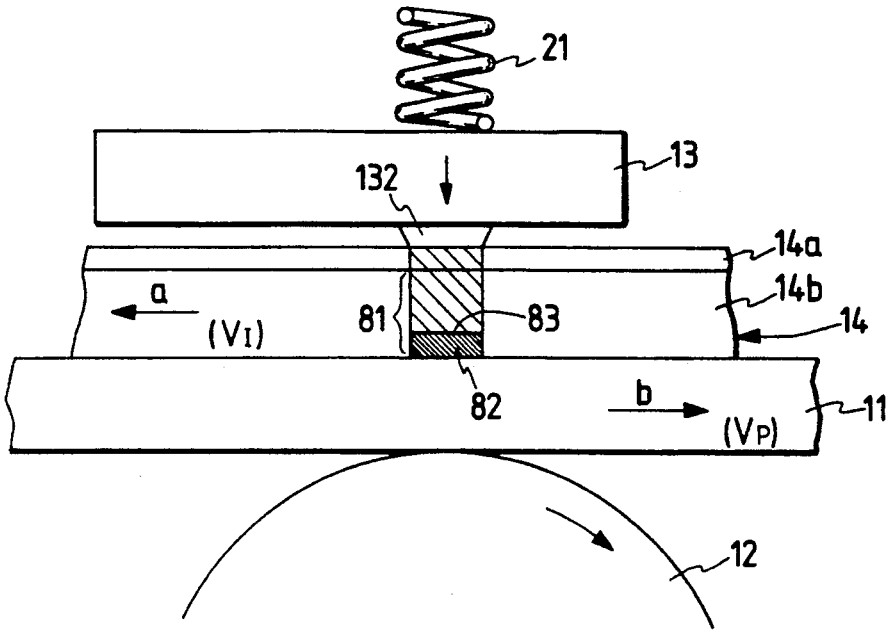
FIG. 16 is a view showing a state of a recording medium and an ink sheet in the recording mode of this embodiment shown in FIG. 15.

Recording Principle (FIG. 16)

FIG. 16 shows an image recording state when the recording sheet 11 and the ink sheet 14 are conveyed in opposite directions like in the above embodiments.

As shown in FIG. 16, the recording sheet 11 and the ink sheet 14 are clamped between the platen roller 12 and the thermal head 13, and the thermal head 13 is pressed against the platen roller 12 by the springs 21 at a predetermined pressure. The recording sheet 11 is conveyed at a speed $V_P$ in the direction of the arrow b upon rotation of the platen roller 12. Meanwhile, the ink sheet 13 is conveyed at a speed $V_I$ in the direction of the arrow a upon rotation of the motor 25.

When the heat generating resistor 132 of the thermal head 13 is energized by the power source 105 to be heated, a portion of the ink sheet 14 indicated by a hatched portion 91 is heated. FIG. 16 illustrates a base film 14*a* of the ink sheet 14, and an ink layer 14*b* of the ink sheet 14. An ink in the ink layer portion 91 heated upon energization of the heat generating resistor 132 is melted, and a portion 92 is transferred to the recording sheet 11. The transferred ink portion 92 corresponds to about 1/n of the ink layer.

When an ink is transferred, a shearing force for an ink must be generated at a boundary line 93 of the ink layer 14*b* to transfer only the portion 92 onto the recording sheet 11. The shearing force varies depending on the temperature of the ink layer, and as the temperature of the ink layer increases, the shearing force tends to decrease. When the heat time of the ink sheet 14 is shortened, the shearing force in the ink layer increased. Therefore, the relative speed between the ink sheet 14 and the recording sheet 11 is increased, so that the ink layer to be transferred can be reliably separated from the ink sheet 14.

According to this embodiment, since a heat time of the thermal head 13 in the facsimile apparatus is as short as about 0.6 ms, the ink sheet 14 and the recording sheet 11 are conveyed in opposite directions, thereby increasing the relative speed between the ink sheet 14 and the recording sheet 11.

Figure 17:
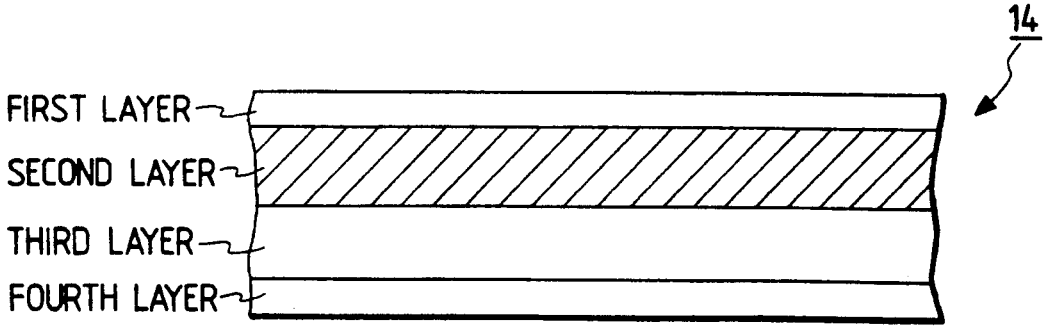
FIG. 17 is a sectional view of a multi-ink sheet used in this embodiment.

Ink Sheet (FIG. 17)

FIG. 17 is a sectional view of an ink sheet used in a multi-print mode of this embodiment. The ink sheet is constituted by four layers.

A second layer is a base film serving as a support of the ink sheet 14. In the multi-print mode, since a heat energy is repeatedly applied to any given portion, an aromatic polyamide film or condenser paper is preferable. A conventional polyester film can be used. The thicknesses of these films are decreased as much as possible in terms of printing quality, and preferably falls within the range of 3 to 8 μm in terms of a mechanical strength.

The third layer is an ink layer which contains an ink in an amount which can be transferred onto a recording sheet several times. Major components, e.g., a resin such as EVA as an adhesive, carbon black or nigrosine dye used for coloring, a carnauba wax or paraffin wax as a binding material, and the like are mixed to withstand a several times of use at an identical position. A coating amount of an ink layer preferably falls within a range of 4 to 8 g/m$^2$. A sensitivity and a density can be varied depending on the coating amount, and the coating amount can be arbitrarily selected.

The fourth layer is a top coating layer for preventing an ink in the third layer from being transferred to a recording sheet under pressure in a non-printing portion, and comprises, e.g., a transparent wax. Thus, only the transparent fourth layer is transferred under pressure, and background contamination of a recording sheet can be prevented. The first layer is a heat-resistant coating layer for protecting the base film as the second layer from heat of the thermal head 13. This layer is suitable for the multi-print mode in which a heat energy for n lines may be applied at any given position (when black information continues), but can be selected as needed. The first layer is effective for a base film formed of a polyester film having a relatively low heat resistance.

The structure of the ink sheet 14 is not limited to that of this embodiment. For example, the ink sheet may be constituted by a base layer and a porous ink holding layer containing an ink and formed on one side of the base layer. Alternatively, the ink sheet may be constituted by a base film, and a heat-resistant ink layer having a microporous net-like structure and formed on the base film, the ink layer containing an ink. The material of the base film may be a film formed of, e.g., polyamide, polyethylene, polyester, polyvinyl chloride, triacetyl cellulose, nylon, or the like, or may be paper. Furthermore, the material of the heat-resistant coating layer includes a silicone resin, a fluoroplastic, ethylcellulose or the like although it need not always be so formed.

As an example of an ink sheet having a thermal sublimation ink, the following ink sheet is known. In this ink sheet, a coloring material layer containing spacer particles formed of a guanamine resin and a fluoroplastic and a dye is formed on a base formed of polyethylene terephthalate, polyethylene naphthalate, an aromatic polyamide film, or the like.

A heating method in a thermal transfer printer is not limited to a thermal head method using the thermal head described above, but may be an energization method or a laser transfer method.

This embodiment exemplifies a case wherein the thermal line head is used. However, the present invention is not limited to this. For example, the present invention may be applied to a so-called serial thermal transfer printer. In this embodiment, the multi-print sheet has been exemplified. However, the present invention is not limited to this. For example, the present invention may be applied to normal thermal transfer recording using a one-time ink sheet.

In each of the above embodiments, the present invention is applied to the facsimile apparatus as a thermal transfer printer. However, the present invention is not limited to this. For example, the present invention is applicable to a wordprocessor, a typewriter, a copying machine, or the like.

The recording medium is not limited to a recording sheet. For example, the recording medium may comprise a fabric, a plastic sheet, or the like as long as an ink can be transferred thereon. The ink sheet is not limited to a sheet roll exemplified in the above embodiment. For example, an ink sheet cassette may be employed. In this case, ink sheets may be stored in a cassette detachable from the recording apparatus main body, and the cassette is attached/detached to/from the main body.

In each of the above embodiment, the thermal head has been exemplified as a recording means. However, the present invention is not limited to this. For example, an ink-jet head for ejected an ink to perform recording on a recording medium may b adopted as a recording means. The ink-jet head comprises very small liquid injection ports (orifices), a liquid flow path, an energy application section arranged in a portion of the liquid flow path, and an energy generating means for generating a liquid droplet formation energy to be applied to the liquid in the energy application section. As the energy generating means, an energy generating means for radiating an electromagnetic wave such as a laser beam so that a liquid absorbs the electromagnetic wave to generate heat, and liquid droplets are ejected and discharge by the heat generation operation, an energy generating means for heating a liquid by an electro-thermal converter to inject a liquid, and the like are known. Of these means, a bubble-jet head is particularly effective for performing high-resolution recording since ejection ports can be arranged with high density. In this head, a drive signal for giving an abrupt temperature rise exceeding nucleate boiling is applied to an electro-thermal converter to cause it to generate a heat energy, and a heat application surface of the heat is caused to perform film boiling, thereby forming bubbles in an ink. Upon growth of the bubbles, ink droplets are injected through injection ports.

As described above, according to the present invention, high-quality recording can be attained.

What is claimed is:

1. A thermal transfer recording apparatus for transferring an ink of an ink sheet onto a recording medium to record an image on said recording medium, comprising:

ink sheet conveying means for conveying said ink sheet;

recording medium conveying means for conveying said recording medium;

recording means for recording said image on said recording medium using said ink sheet; and first drive control means for driving and controlling said recording means in an auxiliary manner to generate heat at a temperature insufficient to cause said recording means to record at a predetermined interval repeatedly between termination of a current image recording operation and commencement of a next image recording operation, wherein said first drive control means counts a time passed after said recording means is driven in said auxiliary manner and a next auxiliary driving of said recording means is performed by counting a predetermined time $\Delta T_n$ ($n>1$), and wherein said predetermined time satisfies a relationship $\Delta T_n < \Delta T_{n+1}$.

2. An apparatus according to claim 1, further comprising second drive control means for controlling said recording means to generate heat after said first drive control means drives said recording means and before said next image recording operation in response to a non-recording period from termination of said first image recording operation to commencement of said next image recording operation.

3. An apparatus according to claim 2, wherein said second control means drives said recording means to generate heat immediately before said next image recording operation when said non-recording period exceeds a first predetermined time period and said second control means does not drive said recording means to generate heat immediately before said next image recording operation when said non-recording period is less than a second predetermined time period.

4. An apparatus according to claim 1, wherein a conveying direction of said ink sheet is opposite to a conveying direction of said recording medium.

5. An apparatus according to claim 1, wherein a conveying speed of said ink sheet is lower than a conveying speed of said recording medium.

6. An apparatus according to claim 1, wherein said recording means comprises a thermal head having a plurality of heat generating elements heated in units of blocks.

7. An apparatus according to claim 6, wherein said plurality of heat generating elements correspond to a width of said recording medium.

8. An apparatus according to claim 1, further comprising receiving means for receiving a transmitted image data and decoding means for decoding said transmitted image data received by said receiving means to obtain a decoded image data, wherein said recording means records said image in response to said decoded image data.

9. An apparatus according to claim 8, wherein a conveying direction of said ink sheet is opposite to a conveying direction of said recording medium.

10. An apparatus according to claim 8, wherein a conveying speed of said ink sheet is lower than a conveying speed of said recording medium.

11. An apparatus according to claim 8, wherein said recording means comprises a thermal head having a plurality of heat generating elements heated in units of blocks.

12. An apparatus according to claim 11, wherein said plurality of heat generating elements correspond to a width of said recording medium.

* * * * *